US012637315B2

(12) United States Patent
Ohya

(10) Patent No.: US 12,637,315 B2
(45) Date of Patent: May 26, 2026

(54) SHEET EJECTION DEVICE AND IMAGE FORMING APPARATUS

(71) Applicant: Ryohhei Ohya, Kanagawa (JP)

(72) Inventor: Ryohhei Ohya, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 97 days.

(21) Appl. No.: 18/376,835

(22) Filed: Oct. 5, 2023

(65) Prior Publication Data

US 2024/0116731 A1 Apr. 11, 2024

(30) Foreign Application Priority Data

Oct. 5, 2022 (JP) ..... 2022-160893

(51) Int. Cl.
*B65H 31/02* (2006.01)

(52) U.S. Cl.
CPC ..... *B65H 31/02* (2013.01); *B65H 2404/63* (2013.01)

(58) Field of Classification Search
CPC ..... B65H 31/02; B65H 2404/63; B65H 31/26
See application file for complete search history.

(56) References Cited

U.S. PATENT DOCUMENTS 8,958,740 B2 * 2/2015 Watanabe ..... G03G 15/6552 271/209
2009/0295061 A1 12/2009 Honda et al.
2015/0274450 A1 10/2015 Fujii et al.
2016/0334748 A1 11/2016 Aoyama et al.
2019/0143719 A1 * 5/2019 Takeda ..... B41J 13/106 347/104
2020/0062529 A1 * 2/2020 Tsuji ..... B65H 31/26
2021/0214176 A1 7/2021 Fukushima et al.
2021/0221636 A1 7/2021 Wakabayashi et al.

FOREIGN PATENT DOCUMENTS

JP 2002-293470 A 10/2002
JP 2002-326732 A 11/2002
JP 2010-006599 A 1/2010
JP 3164689 U 12/2010
JP 2013-071786 A 4/2013
JP 2015-171938 A 10/2015
(Continued)

OTHER PUBLICATIONS

Extended European Search Report issued Mar. 4, 2024 in European Patent Application No. 23201689.9, 11 pages.

*Primary Examiner* — Jennifer Bahls
(74) *Attorney, Agent, or Firm* — XSENSUS LLP

(57) ABSTRACT

A sheet ejection device includes a stacker to stack a sheet ejected to the stacker in a sheet ejection direction, and a contact member to pivot when the contact member is in contact with an ejection sheet moving to the stacker. The contact member includes an ejection sheet contact portion to contact the ejection sheet, a stacked sheet contact portion disposed opposite the ejection sheet contact portion and including a contact portion to contact a stacked sheet stacked on the stacker, and a pressing portion to press the stacked sheet. The pressing portion is disposed at an intersection between the ejection sheet contact portion and the stacked sheet contact portion. The contact portion has a curved shape convex in the sheet ejection direction.

10 Claims, 17 Drawing Sheets

(56) References Cited

FOREIGN PATENT DOCUMENTS

| | | | | | |
|---|---|---|---|---|---|
| JP | 2015-196570 | A | | 11/2015 | |
| JP | 2016-040192 | A | | 3/2016 | |
| JP | 2017-081686 | A | | 5/2017 | |
| JP | 2017-100878 | A | | 6/2017 | |
| JP | 2019151491 | A | * | 9/2019 | ..... B65H 29/12 |
| JP | 2020-175980 | A | | 10/2020 | |

* cited by examiner

SHEET EJECTION DEVICE AND IMAGE FORMING APPARATUS

CROSS-REFERENCE TO RELATED APPLICATION

This patent application is based on and claims priority pursuant to 35 U.S.C. § 119(a) to Japanese Patent: Application No. 2022-160893, filed on Oct. 5, 2022, in the Japan Patent Office, the entire disclosure of which is hereby incorporated by reference herein.

BACKGROUND

Technical Field

Embodiments of the present disclosure relate to a sheet ejection device and an image forming apparatus including the sheet ejection device.

Background Art

Currently, image forming apparatuses with electrophotography are desired to be various in functions and compact in size. Then, typical examples of image forming apparatuses include a printer and a multifunction peripheral (MFP) including a printer, a combination of a printer and a scanner as a reading device, or a combination of a printer and an automatic document feeder (ADF). Then, such image forming apparatuses each include a sheet ejection mechanism that ejects a sheet.

The sheet ejected by such a sheet ejection mechanism passes through a fixing mechanism that is provided in the image forming apparatus and applies heat and pressure to a sheet. Due to such a configuration, in some cases, the sheet is likely to have a back curl or side curl. The subsequent sheet is likely to be caught by the sheet having a back curl or side curl to push out the sheet. Thus, in order to prevent such an inconvenience, a technique is known that a pressing member on the same axis as a sheet ejection roller in a sheet ejection mechanism presses a curl of a stacked sheet to prevent the subsequent sheet from being caught by the preceding sheet, enhancing the sheet stackability. In such a case, for enhancing the sheet stackability, it is desirable that any stacked sheet be prevented from being pushed out at the time of a rise of the pressing member.

For example, a sheet ejection device in the art includes sheet ejection rollers, sheet ejection driven rollers opposed one-to-one to the sheet ejection rollers, at least two end-side pressing members that are disposed pivotably on the rotary shaft of the sheet ejection rollers and each press a side-face portion of a sheet being ejected, and at least two inside pressing members that are disposed pivotably on the rotary shaft of the sheet ejection rollers and each press a side-face portion of a sheet, in which, in a non-retracted state, the inside pressing members and the end-side pressing members each extend from the rotary shaft across the common tangent line between each sheet ejection roller and the corresponding sheet ejection driven roller, the end-side pressing members are longer than the inside pressing members, and the end-side pressing members and the inside pressing members can be mounted on sheets piled on a sheet stacker.

An image forming apparatus in the art includes a housing, an ejection member that is provided in the housing and ejects, to a sheet ejection tray, a sheet to which an image has been already fixed, a pressing member that is located on the downstream side in the sheet ejection direction of the ejecting member in the housing and is displaceable from a pressing position, at which the pressing member can press a face of the sheet opposite to the other face of the sheet on the side of location of the sheet ejection tray, in a direction in which the pressing to the sheet is released, and a pressing-force changer that can make a change in the pressing force of the pressing member to the sheet.

SUMMARY

Embodiments of the present disclosure described herein provide a novel sheet ejection device including a stacker to stack a sheet, and a contact member to pivot in response to contact with an ejection sheet to be ejected to the stacker. The contact member includes an ejection sheet contact portion to contact the ejection sheet, a stacked sheet contact portion disposed opposite the ejection sheet contact portion, the stacked sheet contact portion including a contact portion to contact a stacked sheet stacked on the stacker, and a pressing portion to press the stacked sheet. The contact portion and the pressing portion are connected in a curved shape convex in a sheet ejection direction.

Further, embodiments of the present disclosure described herein provide an image forming apparatus including the above-described sheet ejection device and an image forming device to form an image on the sheet.

BRIEF DESCRIPTION OF THE SEVERAL VIEWS OF THE DRAWINGS

Exemplary embodiments of this disclosure will be described in detail based on the following figures, wherein.

Figure 1:
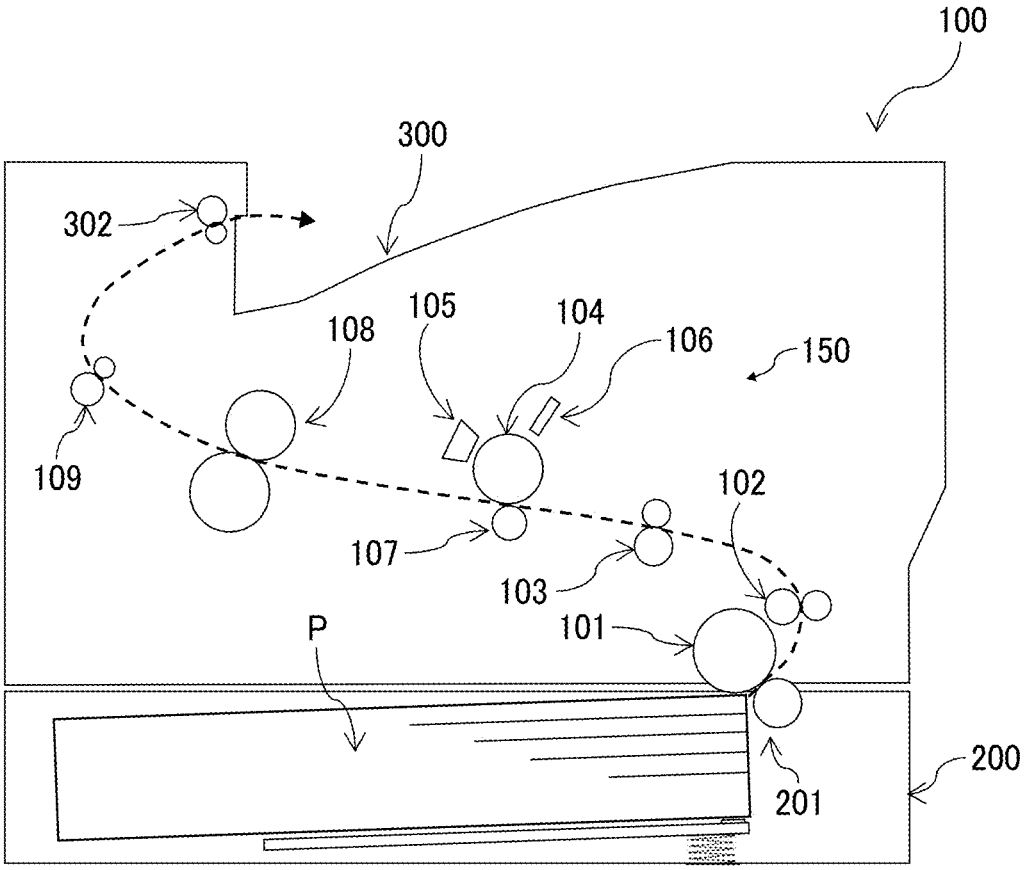
FIG. 1 is a diagram illustrating a configuration of an image forming apparatus according to according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. As used herein, the term "connected/coupled" includes both direct connections and connections in which there are one or more intermediate connecting elements. Like numbers refer to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural turns as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Embodiments of the present embodiment will be described below with the drawings.

Image Forming Apparatus in the Present Embodiment

FIG. 1 is a diagram illustrating a configuration of an image forming apparatus according to according to an embodiment of the present disclosure.

FIG. 1 is a schematic view of a printer 100 as an image forming apparatus according to an embodiment of the present disclosure.

The printer 100 includes a sheet feed roller 101, a relay roller 102, a registration roller 103, a photoconductor 104, a charger 105, a light emitting diode (LED) 106, a transfer roller 107, a fixing roller 108, a conveyance roller 109, and a sheet ejection roller 302.

The printer 100 has a lower portion equipped with a sheet feeding device 200.

The sheet feeding device 200 is housed inside the printer 100. A separation roller 201 included in the sheet feeding device 200 and the sheet feed roller 101 disposed in the printer 100 feed a sheet P (e.g., a recording sheet) as a recording medium from the sheet feeding device 200 to the printer 100.

The sheet feeding device 200 including the separation roller 201 serves as a sheet feeder in the printer 100. The sheet P fed from the sheet feeding device 200 is conveyed to a conveyance passage, indicated with a dashed arrow, by the relay roller 102 and then is temporarily stopped by the registration roller 103, followed by formation of slack. Then, the sheet P is conveyed to an image forming device 150 including the photoconductor 104 by the sheet feed roller 101, the relay roller 102, and the registration roller 103.

The image forming device 150 includes, around the photoconductor 104, the charger 105 that charges the surface of the photoconductor 104 and the LED 106 as a light source that exposes, based on image information, the surface of the charged photoconductor 104 to form an electrostatic latent image on the surface of the photoconductor 104. An image to be transferred to the sheet P is formed due to the operation of the image forming device 150.

Conveyance of the sheet due to the registration roller 103 starts at a predetermined timing to a toner image formed on the photoconductor 104. Thus, the sheet P is conveyed between the photoconductor 104 and the transfer roller 107 disposed opposite the photoconductor 104, so that the toner image on the photoconductor 104 is transferred to the sheet P.

After the transfer of the toner image onto the sheet P, the sheet P is conveyed to the fixing roller 108 that fixes the transferred toner image, and then is ejected to a sheet ejection device 300 provided on the upper face of the housing of the printer 100 through the conveyance roller 109 and the sheet ejection roller 302.

Sheet Ejection Device according to an Embodiment of the Present Disclosure

Figure 2:
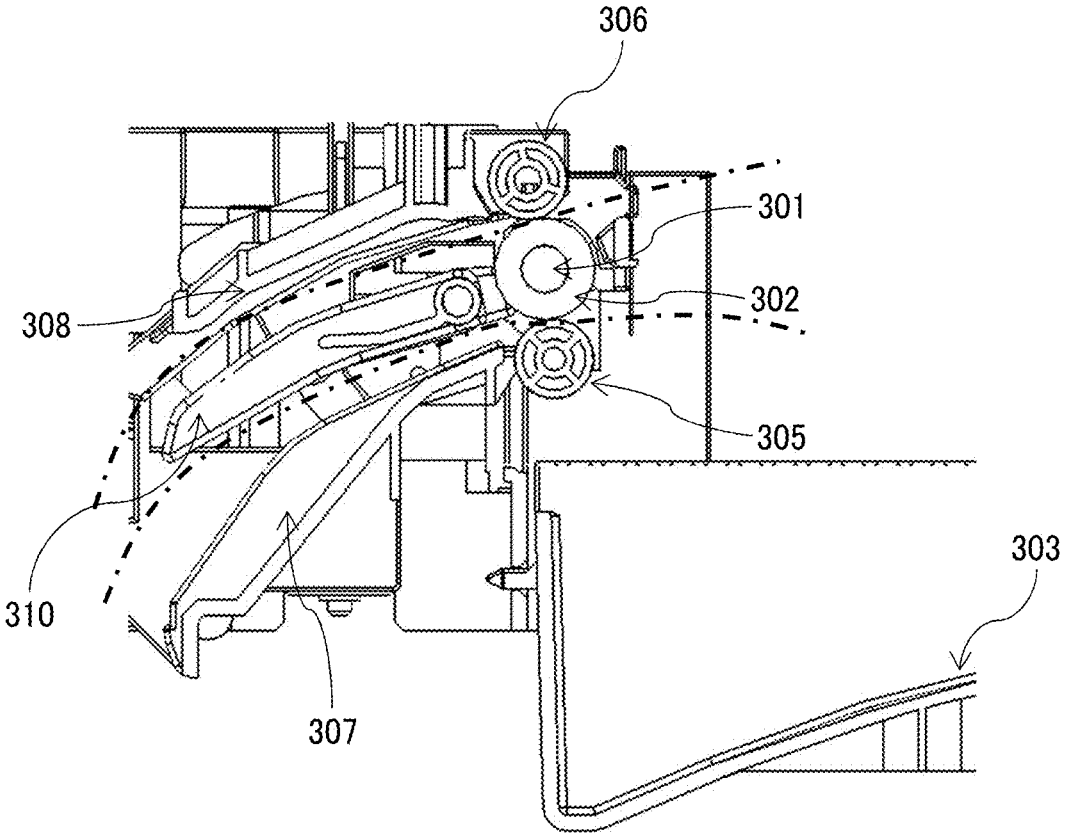
FIG. 2 is a side view of a sheet ejection device according to an embodiment of the present disclosure.
Figure 3:
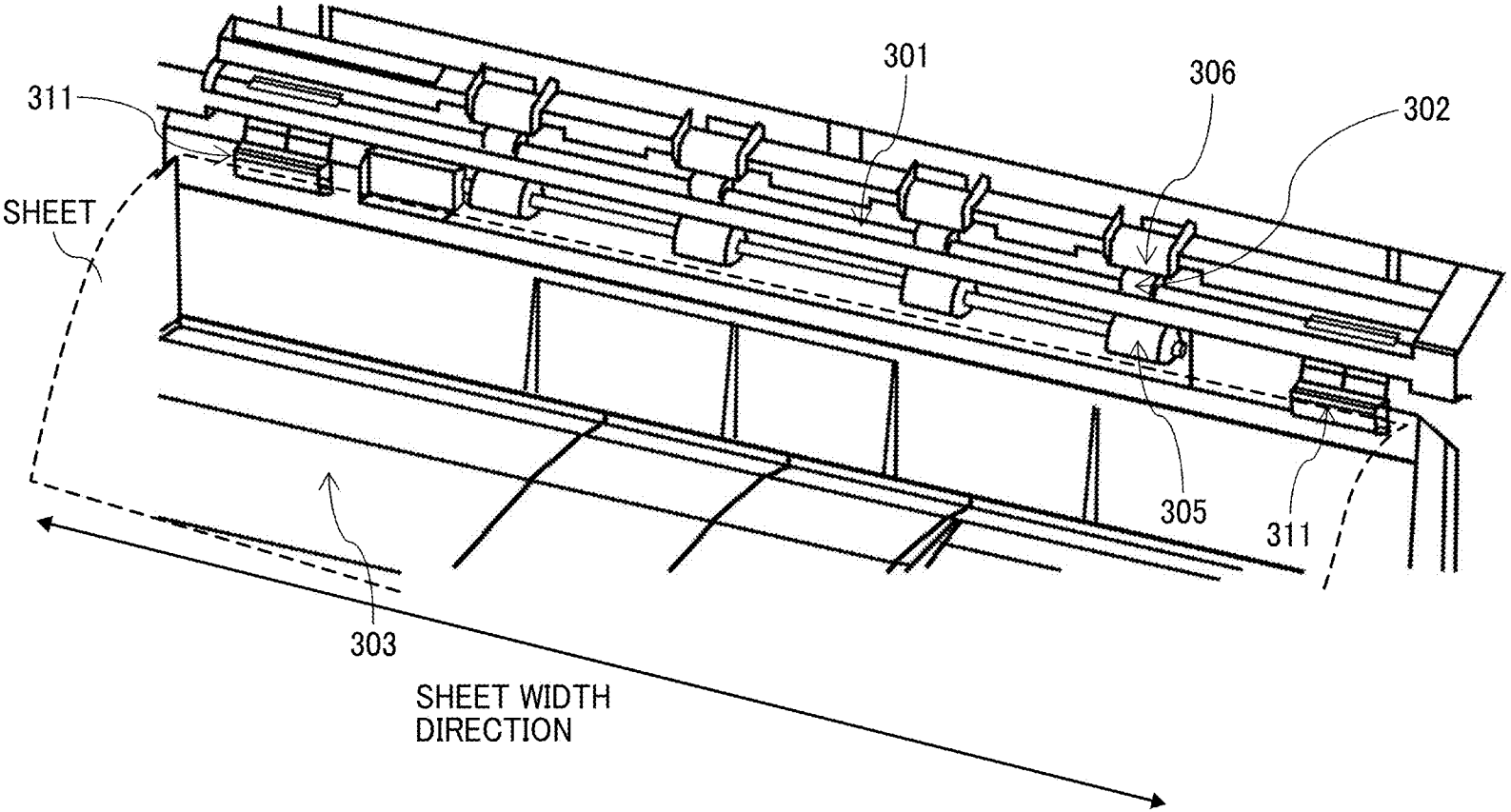
FIG. 3 is a perspective view of the sheet ejection device according to an embodiment of the present disclosure.

A description is now given of the sheet ejection device according to an embodiment of the present disclosure embodiment, with reference to FIGS. 2 and 3.

FIG. 2 is a side view of the sheet ejection device 300 (serving as a sheet ejection device).

The sheet ejection device 300 according to the present embodiment includes a rotary shaft 301 (serving as a contact member support), the sheet ejection roller 302, and a drive source for driving the rotary shaft 301 and the sheet ejection roller 302, in which the rotary shaft 301 and the sheet ejection roller 302 rotate due to the drive source.

The sheet ejection device 300 includes a sheet ejection driven roller 305 and a sheet reverse driven roller 306. The sheet ejection driven roller 305 rotates in a driven manner due to the sheet ejection roller 302 to convey a sheet P to a sheet ejection tray (serving as a stacking portion and also referred to as a sheet stacking tray) 303 for stacking sheets. The sheet reverse driven roller 306 rotates in a driven manner due to the sheet ejection roller 302 to reverse a sheet P during conveyance. The sheet ejection tray 303 according to the present embodiment has an angle of inclination of 20 degrees to 24 degrees.

The sheet ejection device 300 includes a guide 307 and a guide 308. The guide 307 conveys a sheet P to the contact portion between the sheet ejection roller 302 and the sheet ejection driven roller 305. The guide 308 conveys a sheet P to the contact portion between the sheet ejection roller 302 and the sheet reverse driven roller 306.

The sheet ejection device 300 further includes a switch guide 310 that switches, for the conveyed sheet P, the conveyance passage to either the contact portion between the sheet ejection roller 302 and the sheet ejection driven roller 305 or the contact portion between the sheet ejection roller 302 and the sheet reverse driven roller 306. The switch guide 310 is controlled by a switch controller.

FIG. 3 is a perspective view of the sheet ejection device according to an embodiment of the present disclosure.

The sheet ejection device 300 includes a pressing member 311 (serving as a contact member) that presses, at the time of ejection of a sheet P, a curl generated on the sheet R The pressing member 311 is supported pivotably to the rotary shaft 301 of the sheet ejection roller 302 and is fixed so as not to be synchronized with the operation of rotation of the sheet ejection roller 302. The pressing member 311 is fitted to a groove with which the rotary shaft 301 is provided or is disposed with a retaining ring, regulating the movement of the pressing member 311 in the axial direction on the rotary shaft 301.

The position at which the pressing member 311 is disposed may be determined depending on uses. For example, the pressing member 311 is disposed corresponding to an end portion of a sheet having a predetermined size, so that a curl generated on the end portion of the sheet can be pressed. The pressing member 311 is disposed corresponding to the center portion of such a sheet, so that a curl generated on the center portion of the sheet can be pressed. Then, the number of pressing members 311 to be disposed may be determined depending on uses. Examples of the object sheet sizes in the present embodiment includes a B4-size sheet in portrait orientation, an A4-size sheet in landscape orientation, and a letter-size sheet in landscape orientation. Sheets having those sizes are easily curled, so that the pressing member 311 is disposed corresponding to an end portion of such a target.

Figure 4A:
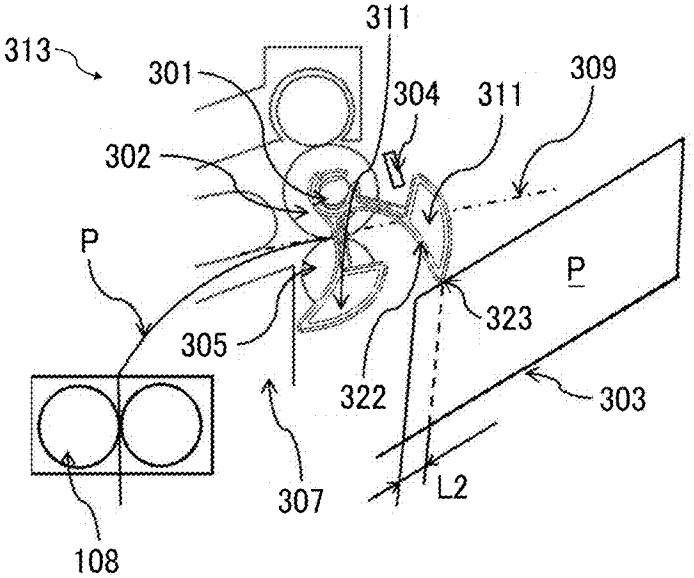
FIGS. 4A, 4B, and 4C are diagrams each illustrating an operation of a pressing member according to an embodiment of the present disclosure.
Figure 4B:
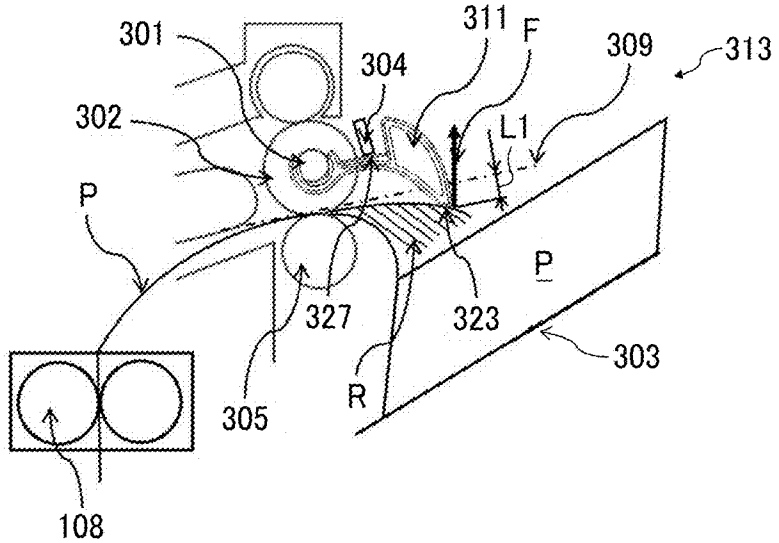
Figure 4C:
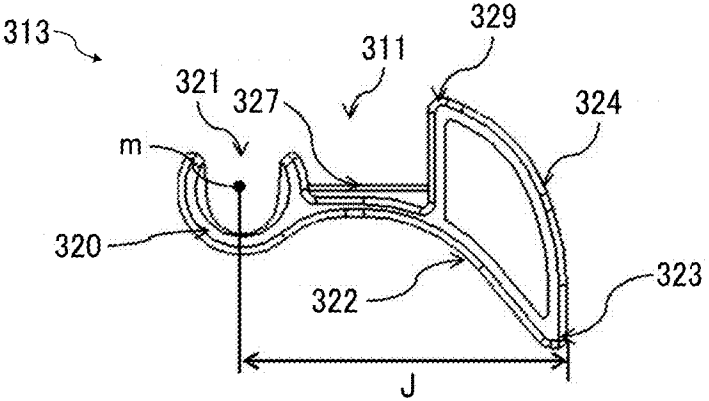

Operation of Pressing Member According to an Embodiment of the Present Disclosure FIGS. 4A, 4B, and 4C are diagrams each illustrating the operation of the pressing member according to an embodiment of the present disclosure.

A detailed configuration of the pressing member according to the present disclosure will be described below.

A sheet P is conveyed, while being nipped between the sheet ejection roller 302 and the sheet ejection driven roller 305, from the fixing roller 108 in a fixing device. Initially, the leading end of the sheet P comes into contact with an ejection sheet contact member 322 of the pressing member 311 in a non-retracted state (see FIG. 4A). The non-retracted state in FIG. 4A indicates "a case where the pressing member 311 is lower in position due to its own weight with any sheet P that is not stacked on the sheet ejection tray 303 inside the locus of pivoting of the pressing member 311 and has a pressing portion 323 contacting the guide 307" or "a case Where the pressing member 311 is lower in position due to its own weight with any of the sheets P that is stacked on the sheet ejection tray 303 inside the locus of pivoting of the pressing member 311 and has the pressing portion 323 placed on the sheets P stacked on the sheet ejection tray 303" (see FIG. 4A).

Referring to FIG. 4A, the pressing member 311 extends from the rotary shaft 301 across a common tangent line 309 between the sheet ejection roller 302 and the sheet ejection driven roller 305. Thus, in contact with a side portion of the ejected sheet P, the pressing member 311 applies, due to its own weight, a downward force to the sheet P to keep the sheet P firm. Thus, an upward side curl of the side portion of the sheet P is pressed.

Then, the sheet P is further conveyed in a direction of ejection of a sheet (referred to as a sheet ejection direction). In this case, in a retracted state (as a maximum retracted state) where a recessed contact portion 327 of the pressing member 311 is in contact with a stopper 304, the pressing portion 323 of the pressing member 311 is located at a distance L1 from the common tangent line 309 to the side of location of the sheet ejection driven roller 305 (see FIG. 4B).

Thus, the pressing member 311 remains in the maximum retracted state due to the elastic force F of the ejected sheet P, and the ejected sheet P is ejected while bending to the sheet ejection tray 303. The sheet ejection direction is set in advance within an electable range R. Due to such a configuration, as the ejected sheet P does not bend excessively to the sheet ejection tray 303, the leading end of the ejected sheet does not push the trailing end of the sheets P stacked on the sheet ejection tray 303.

When the trailing end of the sheet P being ejected passes from between the sheet ejection roller 302 and the sheet ejection driven roller 305, the pressing member 311 returns to the non-retracted state (see FIG. 4A). Then, the pressing member 311 presses down, due to its own weight, the trailing end of the sheet P to the sheet ejection tray 303 or the sheets stacked on the sheet ejection nay 303. The length J of the pressing member 311 from the center "m" of the rotary shaft 301 to the pressing portion 323 is set such that the pressing portion 323 is located at a predetermined distance from the trailing end of the stacked sheets P. Thus, the pressing portion 323 can contact the sheet P.

As above, in contact with the sheet P, the pressing portion 323 presses the sheet. Thus, for example, even if the sheet has an upward side curl, the trailing end of the sheets P stacked on the sheet ejection tray 303 has no curl and is not voluminous. Thus, the height of the stacked sheets is less than the common tangent line 309 between the sheet ejection roller 302 and the sheet ejection driven roller 305. Accordingly, a failure in sheet stacking can be prevented, such as a fall of any of the stacked sheets due to pushing of the trailing end of the sheets P stacked on the sheet ejection tray 303 by the leading end of a sheet being ejected or an error in the order of pages.

Figure 5A:
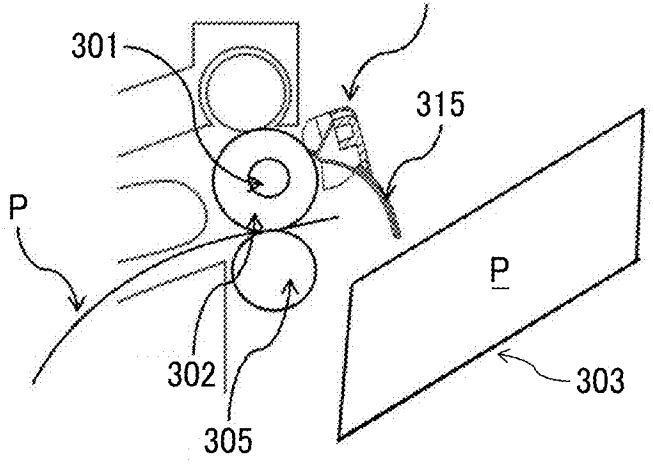
FIGS. 5A, 5B, and 5C are diagrams each illustrating an operation of a sheet full detection mechanism in the sheet ejection device according to an embodiment of the present disclosure.
Figure 5B:
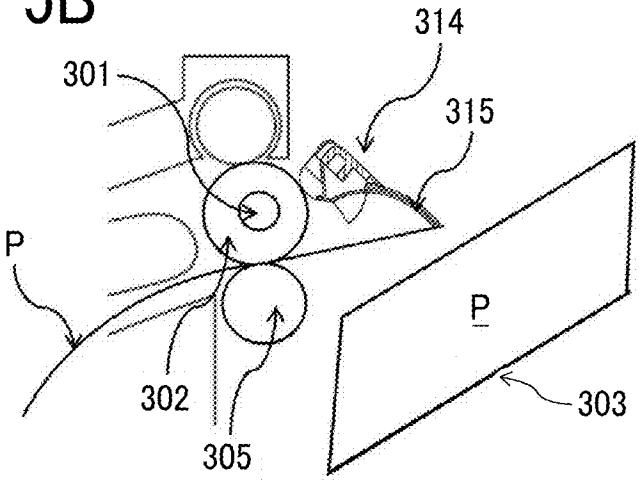
Figure 5C:
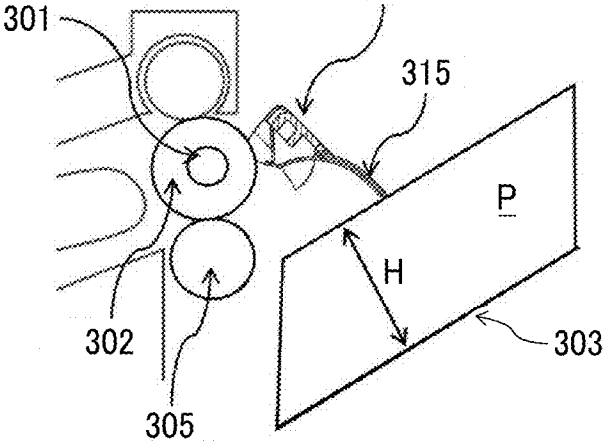

Sheet Full Detection Mechanism in Sheet Ejection Device according to the Present Disclosure FIGS. 5A, 5B, and 5C are diagrams each illustrating an operation of a sheet full detection mechanism in the sheet ejection device according to an embodiment of the present disclosure.

A description is given of a sheet full detection mechanism 313, with reference to FIGS. 5A to 5C.

The sheet full detection mechanism 313 includes a full detection feeler 314 (as a contact member) and a full detection sensor. The full detection feeler 314 is supported pivotably through both end portions in a direction orthogonal to the sheet ejection direction (i.e., the direction orthogonal to the drawing plane in FIGS. 5A to 5C).

The full detection feeler 314 pivots from the position in FIG. 5A to the position in FIG. 5B.

FIG. 5A illustrates a state immediately before the leading end of the sheet P nipped between the sheet ejection roller 302 and the sheet ejection driven roller 305 comes into contact with the center detection portion 315 of the full detection feeler 314. In other words, FIG. 5A illustrates a state before a change is made in the position of the center detection portion 315 or a state where the full detection sensor is OFF.

FIG. 5B illustrates a state where a change is made in the position of the center detection portion 315 because the center detection portion 315 is pushed up by the sheet P or a state where the full detection sensor is ON.

If the ON state of the full detection sensor in the sheet full detection mechanism 313 continues for not less than a predetermined period of time, a controller in the image forming apparatus determines that the quantity of sheets stacked on the sheet ejection tray 303 is full and then generates a signal for stopping printing.

FIG. 5C illustrates such a full state.

Referring to FIG. 5C, the sheets stacked on the sheet ejection tray 303 have a height H.

Details of Sheet Ejection Device according to the Present Disclosure

A description is given of the details of the sheet ejection device according to the present disclosure.

Before the details of the sheet ejection device, a description is given of a configuration of a known sheet ejection device as a comparative example.

Comparative Example

FIGS. 6A, 6B, 6C, and 6D are diagrams each illustrating inconvenience in the configuration of a sheet ejection device according to a comparative example.

Figure 6A:
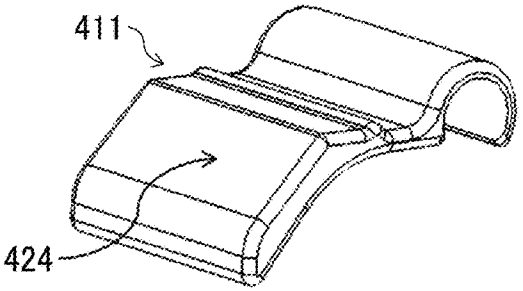
FIGS. 6A, 6B, 6C, and 6D are diagrams each illustrating inconvenience of a sheet ejection device according to a comparative example.

FIG. 6A is a perspective view of a pressing member 411 in the configuration according to the comparative example.

Figure 6B:
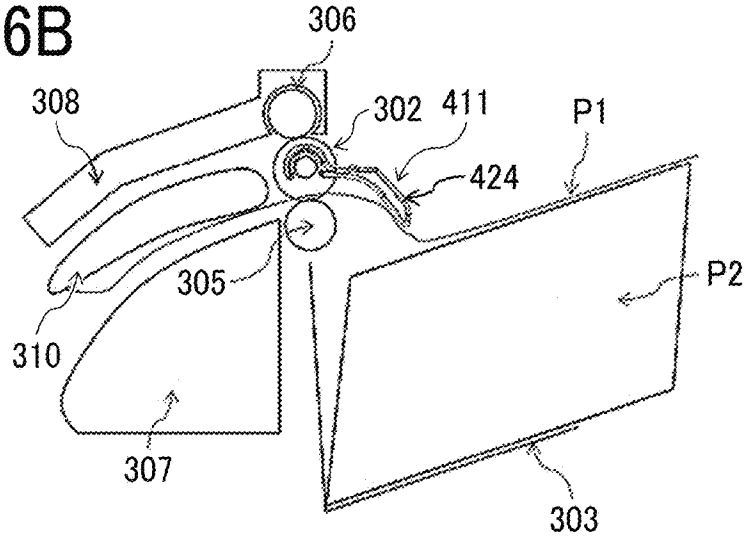
Figure 6C:
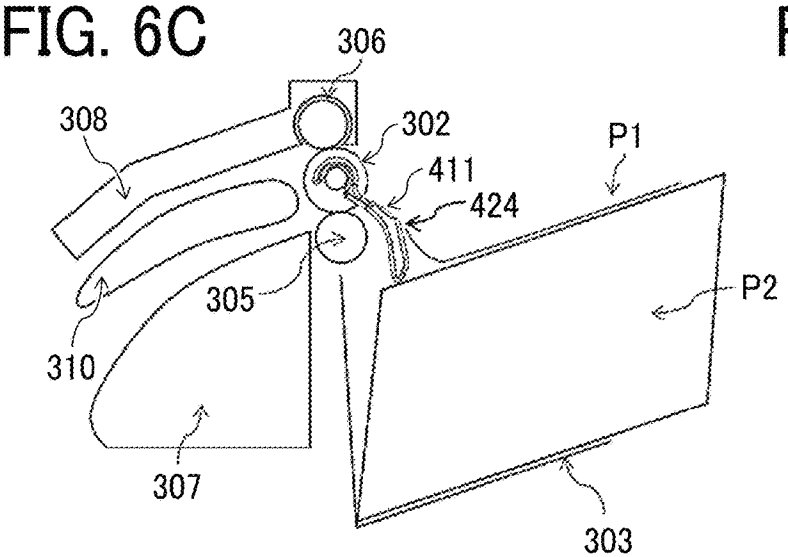
Figure 6D:
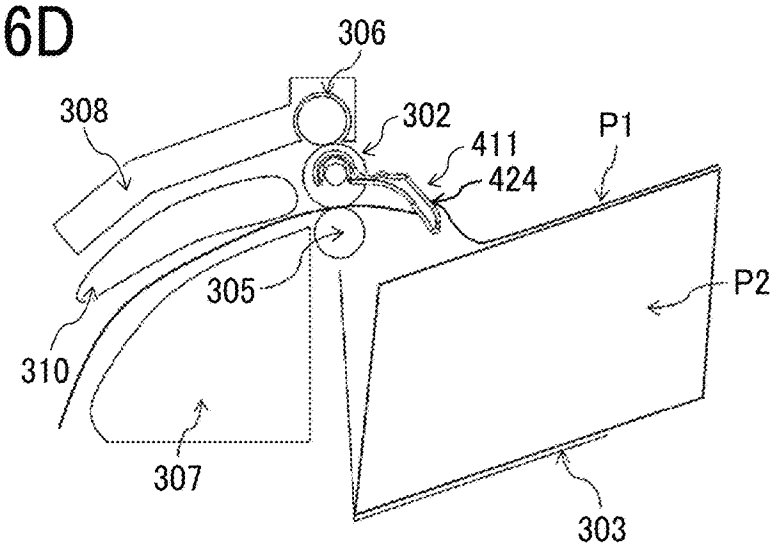

Each of FIGS. 6B, 6C, and 6D illustrates the state of ejection of a sheet with the trailing end having a back curl.

A sheet being ejected is defined as a sheet P1 and sheets stacked on the sheet ejection 303 are defined as sheets P2.

The pressing member 411 in the configuration according to the comparative example includes a stacked sheet contact portion 424 that is located at a predetermined distance from the center of pivoting of the pressing member 411 and comes in contact with a bundle of sheets P stacked on the sheet ejection tray 303. As illustrated in FIG. 6A, simply put, the stacked sheet contact portion 424 extends straight and is straight in shape.

A description is now given of this configuration in which a sheet being ejected is pressed, with reference to FIGS. 6B, 6C, and 6D.

Referring to FIG. 6B, initially, the sheet P1 is stacked on top of the sheets P2 on the sheet ejection tray 303 while pushing up the pressing member 411. In this case, if the force of the sheet being ejected is powerful, the sheet P1 is stacked with the trailing end having passed outside the pressing member 411. Then, as illustrated in FIG. 6C, the sheet P1 that is ejected is pulled back to the pressing member 411 due to the inclination of the sheet ejection tray 303. In this case, because the pressing member 411 falls due to its own weight, the sheet P1 having a back curl is stacked with the trailing end leaning against the pressing member 411.

Then, as in the state in FIG. 6D following the state in FIG. 6C, the subsequent sheet pushes up the pressing member 411, so that the sheet P1 with the back curl stacked on the sheet ejection tray 303 is pushed out to the downstream side in the direction of conveyance (ejection direction) by the pressing member 411 pushed up. Thus, inconveniences occur, such as disorder in the stack of sheets and pushing-out of a sheet. In particular, a multifunction peripheral (MFP) as an image forming apparatus includes a device, such as a scanner, above a sheet ejection tray. In recent years, for effective use of a little installation space, there has been a demand for a small-sized image forming apparatus. In such a configuration, because of a limited space for ejecting a sheet, the sheet ejection tray 303 has a small angle of inclination, that is, the sheet ejection tray 303 is shallow. In such a case, no great effect of pulling a sheet back due to inclination is expected. Thus, the disadvantages described above are more serious.

Pressing Member according to an Embodiment of the Present Disclosure

For prevention of the inconveniences described above, the pressing member according to an embodiment of the present disclosure has the following configuration.

A detailed description is now given of the configuration of the pressing member.

Figure 7B:
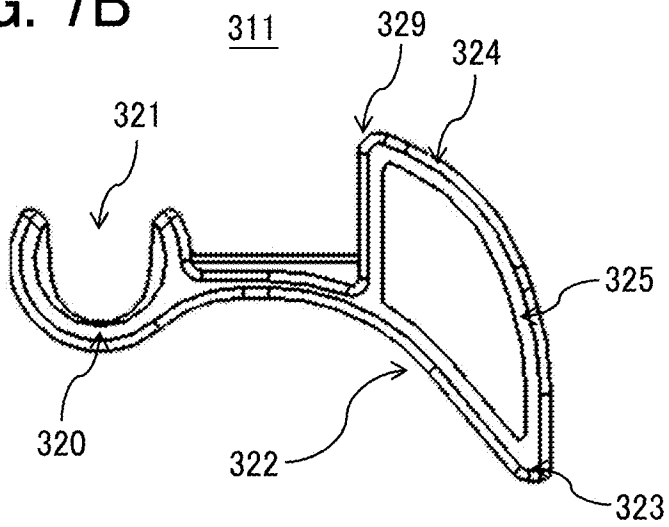
FIGS. 7A, 7B, and 7C are diagrams each illustrating a configuration of the pressing member according to an embodiment of the present disclosure.
Figure 7A:
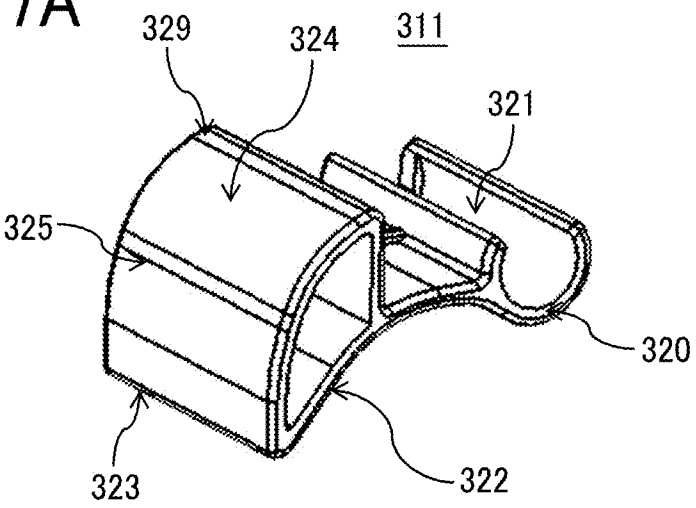
Figure 7C:
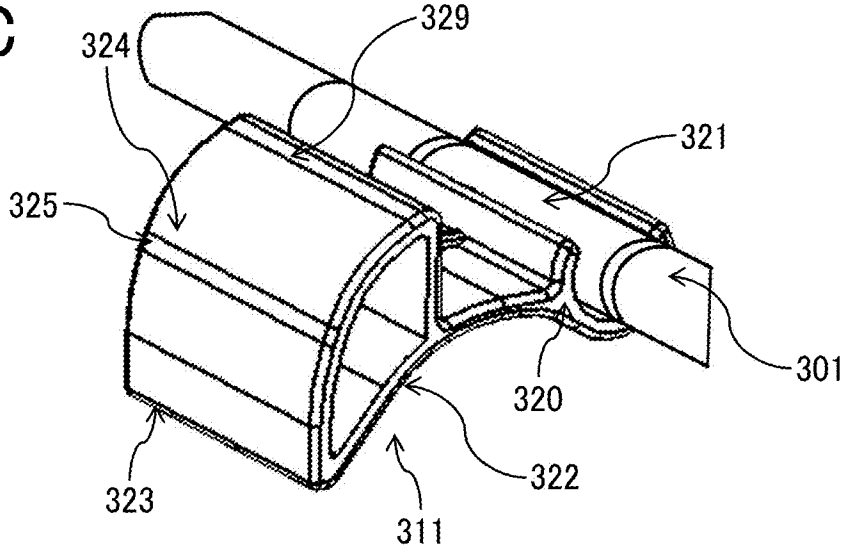

FIGS. 7A, 7B, and 7C are diagrams each illustrating a configuration of the pressing member according to an embodiment of the present disclosure.

FIG. 7A is a perspective view of the pressing member according to the present disclosure.

FIG. 7B is a side view of the pressing member according to the present disclosure.

FIG. 7C is a diagram illustrating a state where the pressing member is supported by the rotary shaft.

The pressing member 311 according to the present disclosure is formed of resin in the present embodiment, but the present embodiment is not limited to this configuration. As illustrated in FIG. 7A, the pressing member 311 includes a support 320 enabling the pressing member 311 to be supported by the rotary shaft 301 in the sheet ejection device 300. Thus, the pressing member 311 can be supported to the sheet ejection device 300. As illustrated in FIG. 7B, the support 320 has a C-shape due to cutting-away of part of a circle in side view. The rotary shaft 301 is inserted through a cutaway portion 321 (as an insertion opening) such that the support 320 is fitted with the rotary shaft 301. Thus, as illustrated in FIG. 7C, the pressing member 311 is supported. The rotary shaft 301 is inserted in the support 320 through the cutaway portion 321 located on the upper side (in other words, the side of location of the sheet reverse driven roller 306 or the opposite side to the side of location of the sheet ejection tray 303), so that the pressing member 311 is supported. For example, the pressing member 311 is made supported with the cutaway portion 321 located on the lower side (i.e., the side of location of the sheet ejection tray 303). In this case, a sheet having a large curl is likely to have its leading end trapped in between the cutaway portion 321 and the rotary shaft 301. From a viewpoint of prevention of such a trap, as described above, the cutaway portion 321 is made located on the upper side. The pressing member 311 includes the ejection sheet contact member 322. The ejection sheet contact member 322 contacts with a sheet ejected from the outlet of the sheet ejection device 300. The ejection sheet contact member 322 serves as a member to guide the conveyance of the ejected sheet to stack the sheet onto the sheet ejection tray 303 or onto the upper portion of a batch of sheets stacked on the sheet ejection tray 303.

The pressing member 311 includes the pressing portion 323. The pressing portion 323 is located at a predetermined distance from the center of pivoting of the pressing member 311 and functions to press a sheet stacked on the sheet ejection tray 303 to the side of location of the sheet ejection tray 303. The pressing portion 323 functions to press a curl generated on a sheet.

The pressing member 311 further includes a stacked sheet contact portion 324. The stacked sheet contact portion 324 is located on the side opposite to the ejection sheet contact member 322 (i.e., the side of location of the sheet reverse driven roller 306). The stacked sheet contact portion 324 includes a contact portion 325 that is located at a predetermined distance from the center of pivoting of the pressing member 311, and contacts a bundle of sheets stacked on the sheet ejection tray 303. The pressing member 311 includes a top portion 329 as an end portion located opposite the pressing portion 323 at the other end portion of the stacked sheet contact portion 324. In other words, the stacked sheet contact portion 324 corresponds to the region between the pressing portion 323 and the top portion 329. The contact portion 325 and the pressing portion 323 are connected in a curved shape convex in the sheet ejection direction.

Referring to FIGS. 7A to 7C, the location of the contact portion 325 is an example and thus varies in accordance with the condition of ejection of a sheet or the condition of stacking. In addition, the contact portion 325 and the top portion 329 are connected in a curved shape convex in the sheet ejection direction. The curved shape of connection of the contact portion 325 and the top portion 329 is different in curvature from the curved shape of connection of the contact portion 325 and the pressing portion 323. As above, the stacked sheet contact portion 324 has multiple curved shapes, different in curvature, in combination. The stacked sheet contact portion 324 may have a curved shape constant in curvature. In other words, the curved face from the pressing portion 323 to the top portion 329 may have a curved shape constant in curvature.

The sheet ejection device 300 includes the stopper 304 (as a stopper).

Figure 8B:
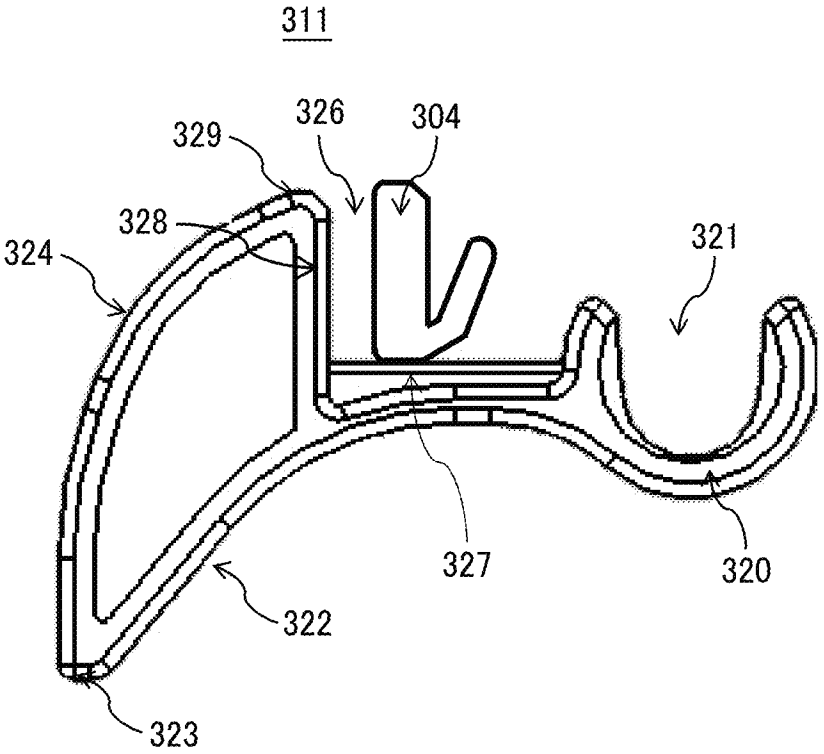
FIGS. 8A and 8B are diagrams each illustrating a configuration of a stopper.
Figure 8A:
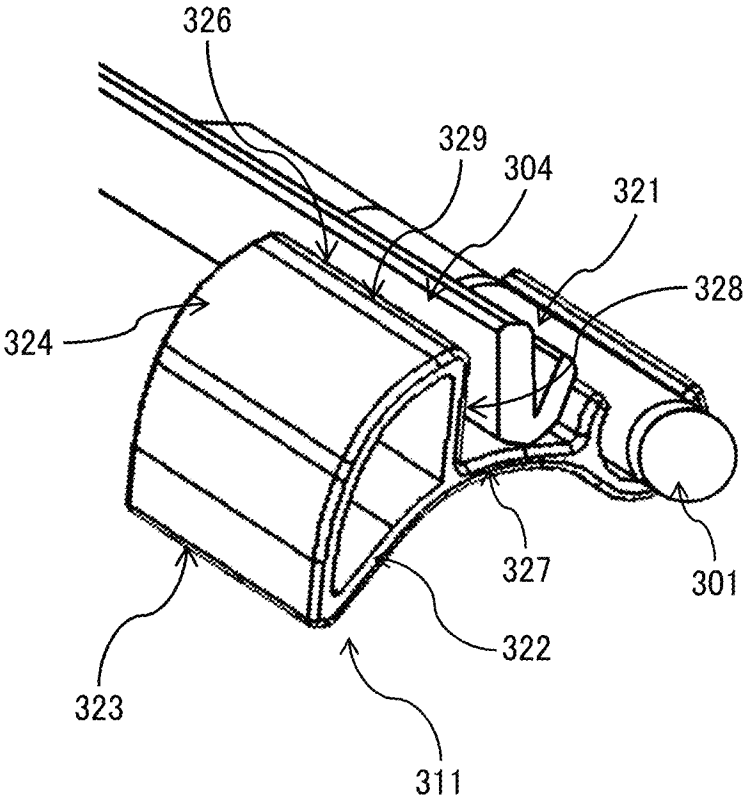

A detailed description is given of the stopper, with reference to FIGS. 8A and 8B.

FIG. 8A is a diagram illustrating a configuration of the pressing member 311 when the pressing member 311 is supported by the rotary shall 301.

FIG. 8B is a side view of the pressing member 311 and the stopper 304, illustrating the relation of the positions of the pressing member 311 and the stopper 304.

The pressing member 311 has a recessed portion 326 such as a recess on the side opposite to the ejection sheet contact member 322 (the side where the sheet reverse driven roller 306 is located). The recessed portion 326 includes a recessed contact portion 327 (as a stopper contact portion) for contact with the stopper 304, a recessed perpendicular portion 328 orthogonal to the recessed contact portion 327, and the top portion 329 at the location of connection of the recessed perpendicular portion 328 and the stacked sheet contact portion 324. The pressing member 311 pivots around the rotary shaft 301 while being pushed up by a sheet, and the pivoting stops in response to contact of the recessed contact portion 327 with the stopper 304. Thus, the pressing member 311 can be determined in posture.

Difference in Pushing Amount of Sheet

Figure 9A:
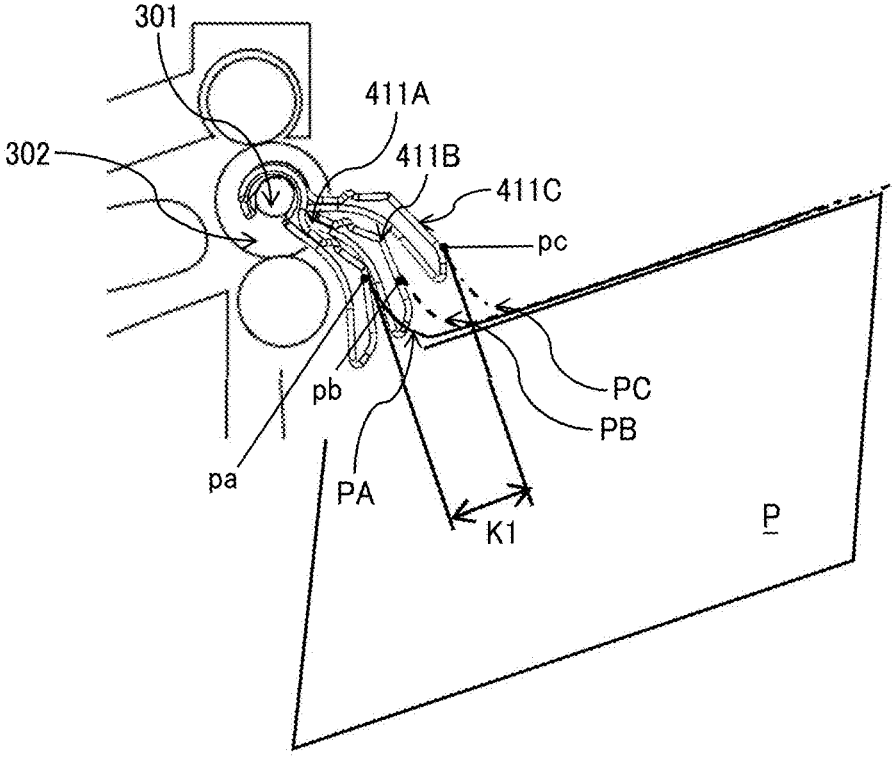
FIG. 9A is a diagram illustrating the difference in the pushed amount of a sheet by the pressing member according to the present disclosure.
Figure 9B:
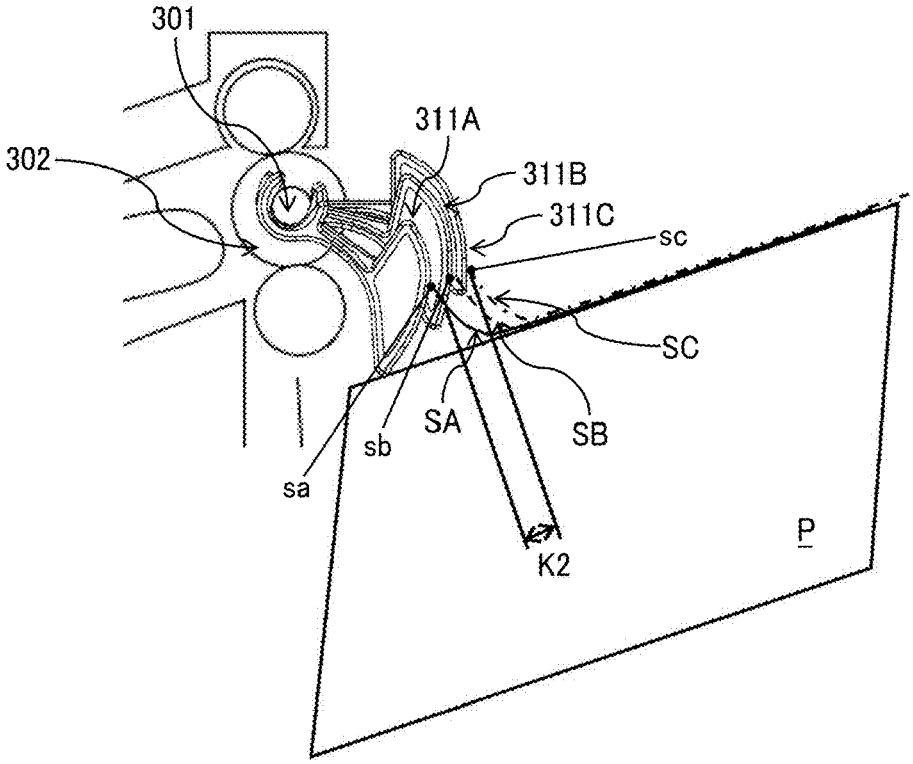
FIG. 9B is a diagram illustrating the difference in the pushed amount of a sheet by the pressing member of the comparative example.

A description is given of the difference in the pushed amount of a sheet by the pressing member according to the present disclosure and the pressing member of the comparative example, with reference to FIGS. 9A and 9B, FIG. 9A is a diagram illustrating the locus of pivoting of the pressing member in pushing up of the pressing member according to the comparative example and the locus of a sheet pushed by the pivoting of the pressing member.

FIG. 9B is a diagram illustrating the locus of pivoting of the pressing member in pushing up of the pressing member according to the present disclosure and the locus of a sheet pushed by the pivoting of the pressing member.

In the following description with reference to FIGS. 9A and 9B, the contact portion between the pressing member and the sheet is indicated as a point of contact, for convenience. However, the pressing member and the sheet are in line contact or in surface contact in practice.

As illustrated in FIG. 9A, in response to pushing-up by the following sheet, the pressing member 411 according to the comparative example pivots in the order of positions 411A, 411B, and 411C. Due to the pivoting of the pressing member 411, the point of contact with the sheet moves excessively in the direction of conveyance (ejection direction) like a point pa, a point pb, and a point pc in this order. In response to this, the sheet moves like a sheet PA (solid line), a sheet PB (dashed line), and a sheet PC (dot-dash line) in this order. The amount of movement of the sheet is defined as an amount of movement K1.

On the other hand, as illustrated in FIG. 9B, in response to pushing-up by the following sheet, the pressing member 311 according to the present embodiment pivots in the order of positions 311A, 311B, and 311C. Due to the rotation of the pressing member 311, the contact point with the sheet moves in the conveying direction (discharge direction) in the order of the point sa, the point sb, and the point sc. Accordingly, the sheet moves in the order of sheet SA (solid line), sheet SB (broken line), and sheet SC (alternate long and short dash line). The amount of movement of the sheet is defined as an amount of movement K2. The relationship between the amounts of movement K1 and K2 fulfills the following condition: K2<K1. In other words, the pressing member 311 according to the present disclosure enables a smaller amount of movement of the point of contact with the sheet in the direction of conveyance (ejection direction).

Figure 10B:
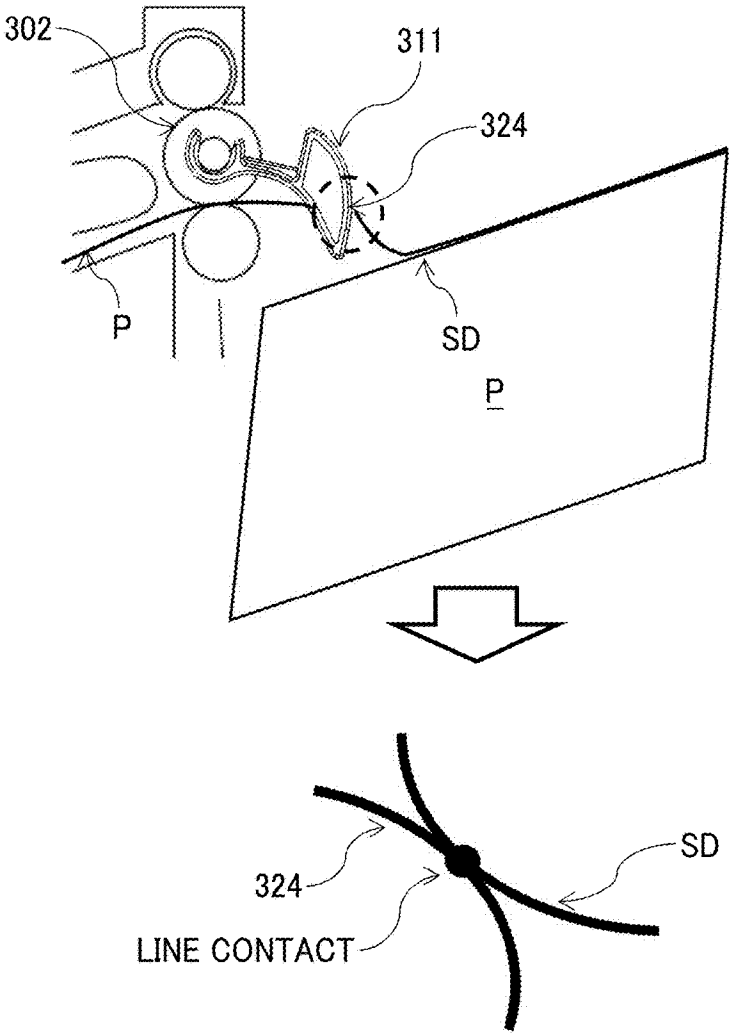
FIGS. 10A and 10B are diagrams each illustrating a mechanism that causes the difference in the pushed amount of a sheet.
Figure 10A:
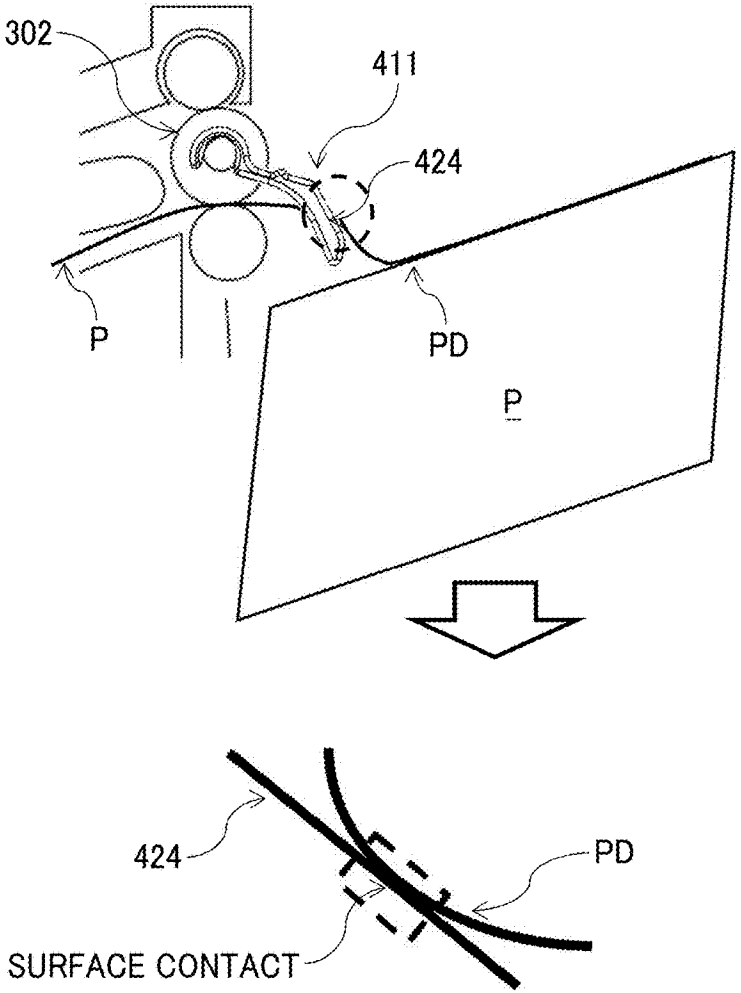

A mechanism that causes the difference in the pushed amount of a sheet between the pressing member according to the comparative example and the pressing member according to the present embodiment will be now described with FIGS. 10A and 10B.

FIG. 10A is a diagram illustrating a mechanism in which the pressing member according to the comparative example scoops up a curled sheet.

FIG. 10B is a diagram illustrating a mechanism in which the pressing member according to the present disclosure scoops up a curled sheet.

The respective lower figures in FIGS. 10A and 10B are each an enlarged schematic view of a part enclosed with a dashed circle in the upper figure.

Regarding the pressing member 411 according to the comparative example, as illustrated in FIG. 10A, the stacked sheet contact portion 424 of the pressing member 411 comes in contact with a curled sheet (for description, referred to as a sheet PD). In this case, the stacked sheet contact portion 424 and the sheet PD are made in surface contact. This is because the stacked sheet contact portion 424 of the pressing member 411 according to the comparative example is straight in shape. In this state, the pressing member 411 scoops up the curled sheet PD, causing a large force of pushing out the sheet PD because of the surface contact between the stacked sheet contact portion 424 and the curled sheet PD. As a result, the sheet PD is pushed out excessively by the pressing member 411 in the sheet ejection direction.

A description is now given of the pressing member 311 according to the present disclosure, in a case where the stacked sheet contact portion 324 of the pressing member 311 comes in contact with a curled sheet (for description, referred to as a sheet SD) as illustrated in FIG. 10B.

In this case, the stacked sheet contact portion 324 and the sheet SD are made in line contact. This is because the stacked sheet contact portion 324 of the pressing member 311 according to the present disclosure is curved in shape. In this state, the pressing member 311 scoops up the curled sheet SD, causing the force of pushing out the sheet SD smaller than the force of pushing out the sheet PD by the pressing member 411 according to the comparative example because of the line contact with the curled sheet SD. As a result, the sheet SD can be prevented from being pushed out by the pressing member 311.

Configuration for Further Prevention of Pushing-Out of Sheet

A detailed description is given of the pressing member 311 having the configuration for further prevention of pushing-out of a sheet.

Figure 11:
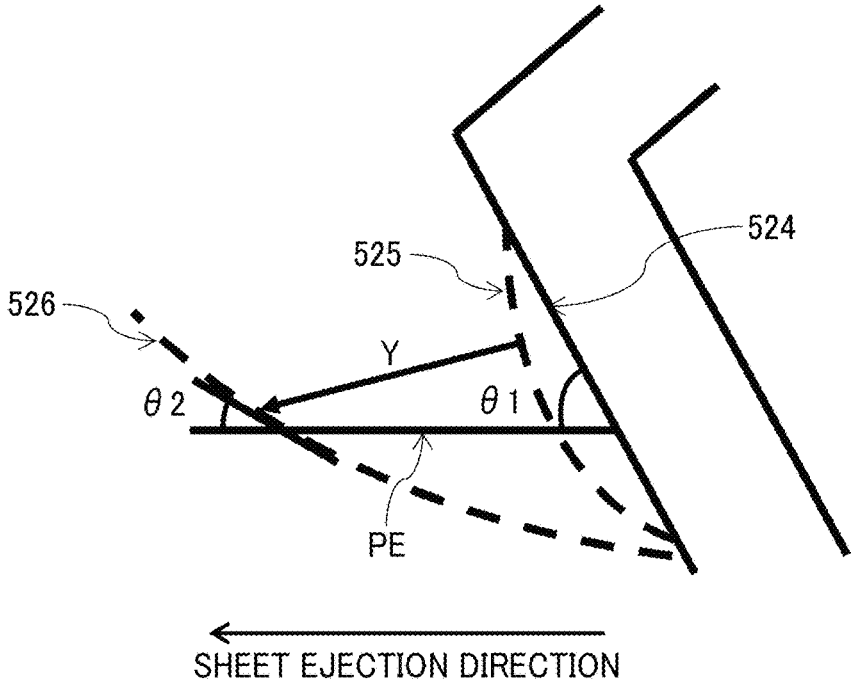
FIG. 11 is a diagram illustrating a configuration of a stacked sheet contact portion for further preventing the pushing-out of a sheet.

FIG. 11 is a diagram illustrating a configuration of the stacked sheet contact portion for further preventing the pushing-out of a sheet.

The stacked sheet contact portion 324 of the pressing member 311 is assumed to be straight in shape like the stacked sheet contact portion 424 of the pressing member 411 according to the comparative example. The shape in this case is defined as a reference 524. In this case, a sheet in contact with the reference 524 is defined as a sheet PE, Then, the shape resulting from simply curving the straight shape is defined as a curved portion 525. The shape of the portion resulting from expanding the curved shape in the direction of an arrow Y in FIG. 11 is defined as a curved portion 526. The angle between the reference 524 and the upper face of the sheet PE is defined as an angle θ1. The angle between the tangent line of the curved portion 526 at the point is defined as an angle θ2. At the point, the curved portion 526 and the sheet PE intersect, and the upper face of the sheet PE is defined as an angle θ2.

The stacked sheet contact portion is made curved in shape to decrease the angle θ1. Then, the angle θ1 decreases like the angle θ2 between the tangent line of the curved portion 526 at the point where the curved portion 526 and the sheet PE intersect and the upper surface of the sheet PE. Then, as the angle θ1 decreases, the curved shape expands so as to be convex in the ejection direction of the sheet PE like a change from the curved portion 525 to the curved portion 526. Such an expanded shape causes a smaller force of pushing out a sheet, in other words, "forming a curved shape to have a smaller angle between the stacked sheet contact portion and the upper face of the sheet" contributes to an effect of prevention of the pushing-out of the sheet. The angle θ1 is desirably less than 90 degrees.

Figure 12:
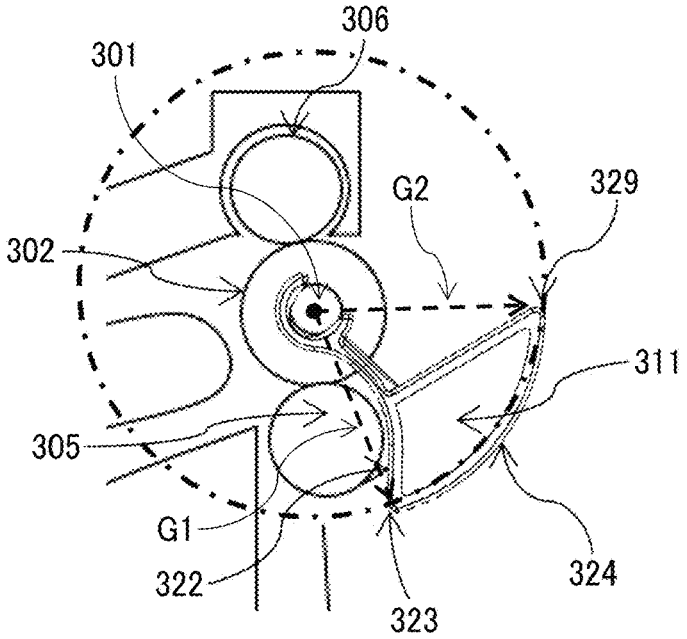
FIG. 12 is a diagram illustrating another configuration of the stacked sheet contact portion for further preventing the pushing-out of a sheet.

FIG. 12 is a diagram illustrating another configuration of the stacked sheet contact portion for further preventing the pushing out a sheet by the stacked sheet contact portion.

As illustrated in FIG. 12, the top portion 329 of the pressing member 311 may serve as a part that presses a curled portion of a stacked sheet (to be mounted on the stacked sheet). A distance G2 from the center of pivoting of the pressing member 311 to the top portion 329 is longer than a distance G1 from the center of pivoting of the pressing member 311 to the pressing portion 323 (larger radius of pivoting). Thus, when the pressing member 311 is pushed up, the stacked sheet contact portion 324 in contact with a stacked sheet having a curl is separated from the sheet. Thus, a sheet can be further inhibited from being pushed out Modification 1

A description is given of the sheet ejection device according to a modification of the present disclosure.

The stacked sheet contact portion 324 of the pressing member 311 illustrated in FIGS. 7A to 7C has a plurality of curved shapes connected from the pressing portion 323 to the top portion 329. The reason is as follows. In response to an increase in the number of stacked sheets on the sheet ejection tray 303, an end portion of a sheet and the curved portion of the stacked sheet contact portion 324 are made in contact. Thus, the end portion of the sheet is prevented from being kicked off at the time of a rise of the pressing member 311. Instead of the configuration described above, the following configuration can be provided.

Figure 13:
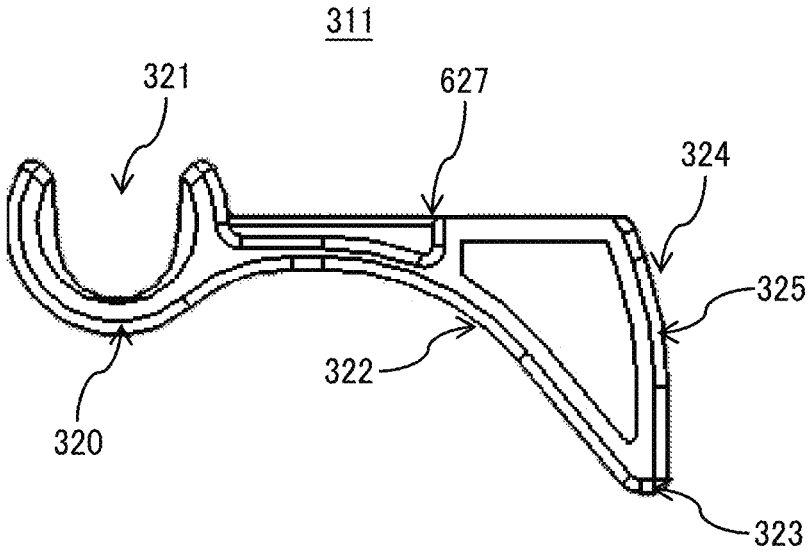
FIG. 13 is a diagram illustrating the pressing member according to Modification 1 of the present disclosure.

The pressing member 311 illustrated in FIG. 13 includes a stopper contact portion 627 (as a stopper contact portion) that contacts on the stopper 304 and the stacked sheet contact portion 324, in which the stopper contact portion 627 extends straight in the sheet ejection direction from the center of pivoting of the pressing member 311 to the stacked sheet contact portion 324. That is, the configuration of the pressing member 311 illustrated in FIG. 13 corresponds to a configuration in which, based on removal of the recessed perpendicular portion 328 of the recessed portion 326 from the pressing member 311 illustrated in FIGS. 7A to 7C, the flat portion of the recessed contact portion 327 extends straight in the sheet ejection direction from the center of pivoting of the pressing member 311 to the stacked sheet contact portion 324. Then, in the side view, the pressing member 311 illustrated in FIG. 13 is semi-fan-shaped. In Modification 1, the pressing member 311 has the contact portion 325 and the pressing portion 323 connected in a curved shape convex in the sheet ejection direction.

Such a configuration enables an effect of preventing a sheet from being pushed out.

Modification 2

A description is given of the sheet ejection device according to another modification of the present disclosure.

Figure 14B:
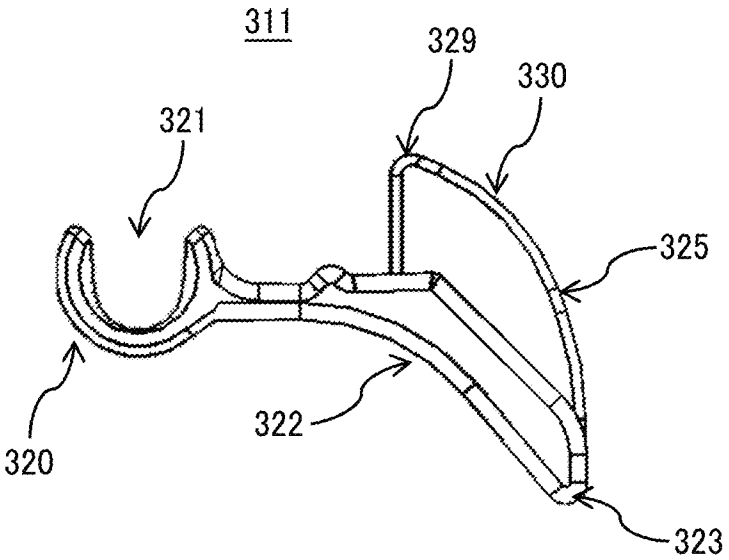
FIGS. 14A and 14B are diagrams each illustrating the pressing member according to Modification 2 of the present disclosure.
Figure 14A:
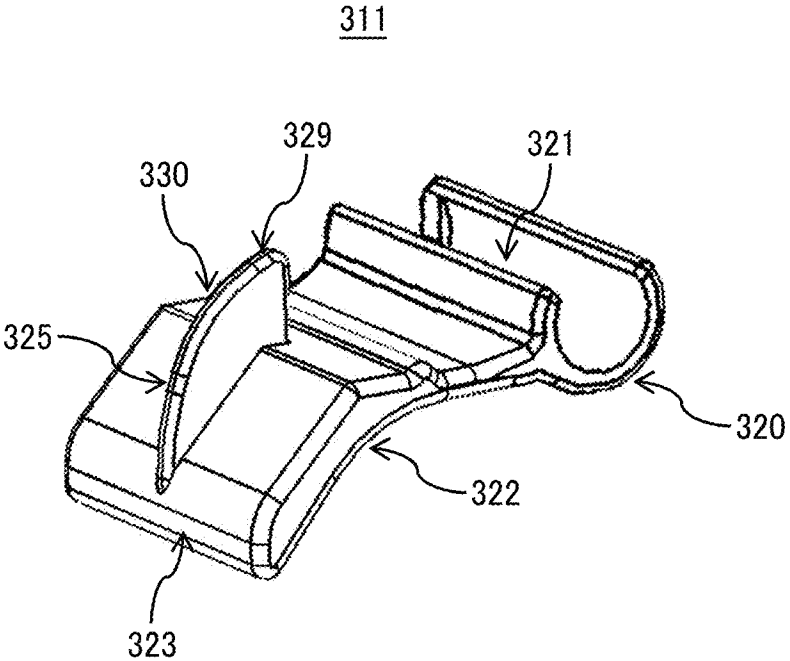

In the pressing member 311 illustrated in FIGS. 7A to 7C, the curved portion of the stacked sheet contact portion 324 ranges over the entirety in the sheet width direction of the pressing member 311. On the other hand, as shown in FIG. 14, the curved portion of the stacked sheet contact portion 324 may be linearly formed only in a part of the pressing member 311 in the sheet width direction to form a rib 330. The rib 330 can be regarded as a rib protruding from the straight stacked sheet contact portion 424 of the pressing member 411 according to the comparative example as illustrated in FIG. 6A. In Modification 2, the pressing member 311 has a contact portion 325 and a pressing portion 323 connected in a curved shape convex in the sheet ejection direction.

Such a shape enables the pressing member 311 and a sheet in line contact, leading to a reduction in the frictional force between the pressing member 311 and the sheet.

Modification 3

A description is given of the sheet ejection device according to still another modification of the present disclosure.

Figure 15B:
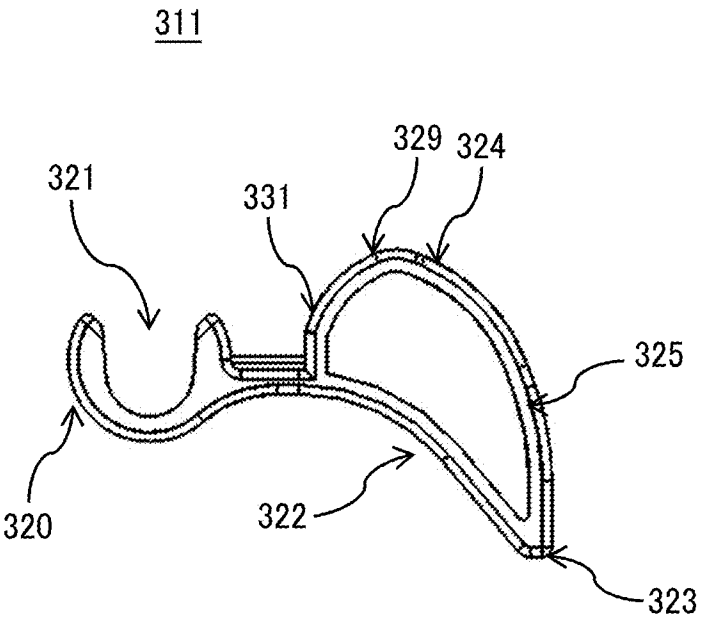
FIGS. 15A and 15B are diagrams each illustrating the pressing member according to Modification 3 of the present disclosure.
Figure 15A:
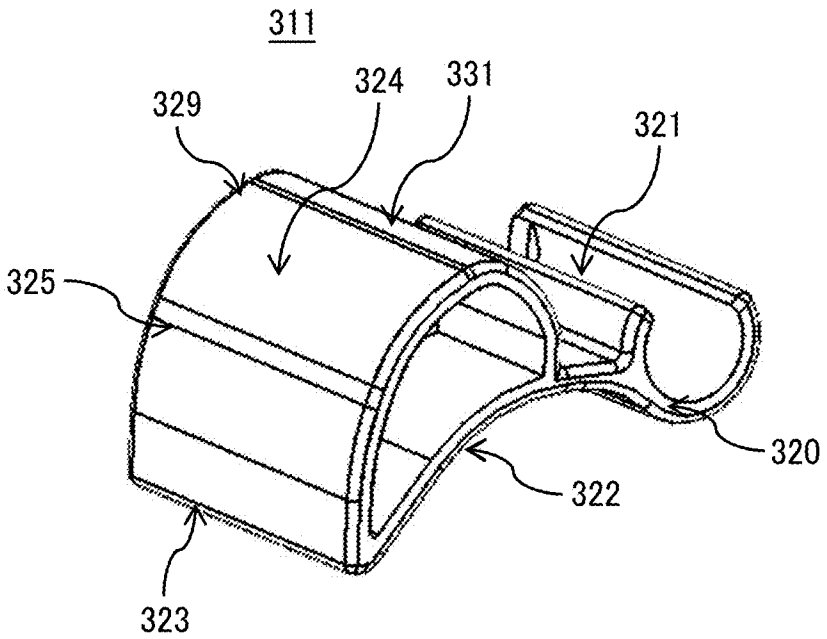

In comparison to the pressing member 311 illustrated in FIGS. 7A to 7C, the pressing member 311 illustrated in FIGS. 15A and 15B includes a second stacked sheet contact portion 331 in a curved shape ranging from the top portion 329 to the recessed contact portion 327.

Figure 16B:
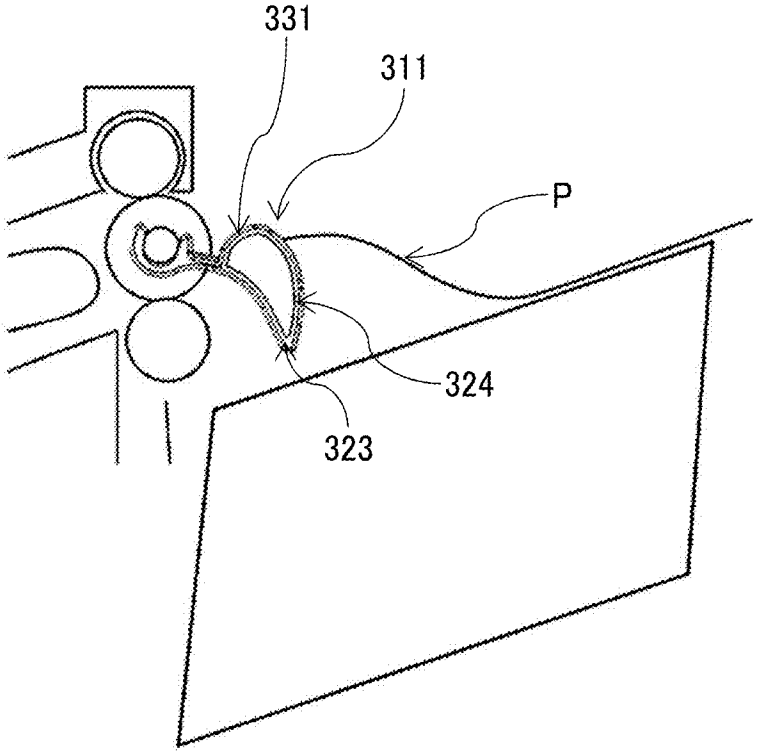
FIGS. 16A and 16B are diagrams each illustrating a state where the kicking-off of a sheet in Modification 3.
Figure 16A:
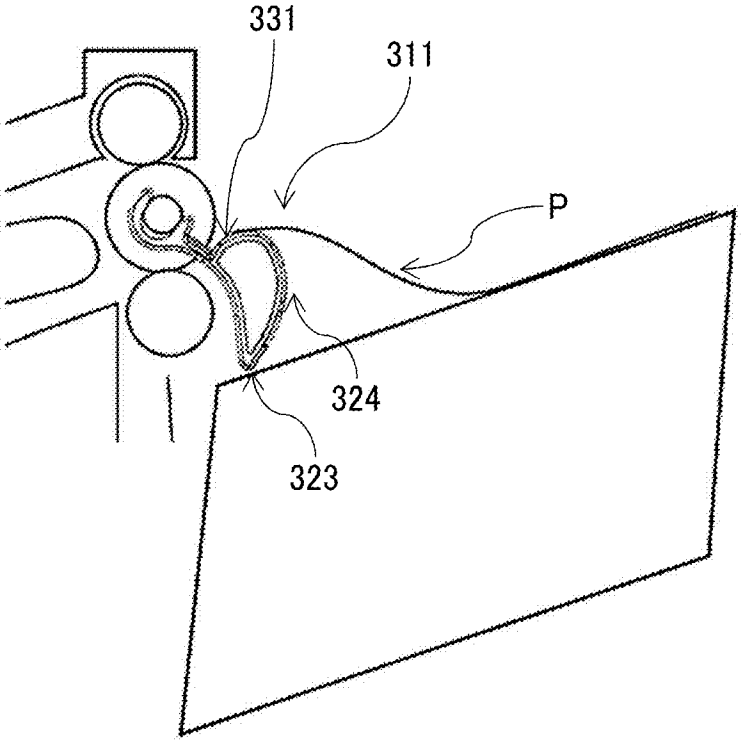

FIGS. 16A and 16B are diagrams each illustrating a state where the kicking-off of a sheet in Modification 3.

The second stacked sheet contact portion 331 has a convex shape that is curved so as to bulge in a direction opposite to the bulging direction of the stacked sheet contact portion 324 (i.e., the opposite to the discharge direction).

Such a configuration enables, even when a sheet P is stacked over the stacked sheet contact portion 324 as illustrated in FIG. 16A, an effect of preventing, by the second stacked sheet contact portion 331, the sheet P from being kicked off at the time of a rise of the pressing member 311 as illustrated in FIG. 16B.

Modification 4

Figure 17A:
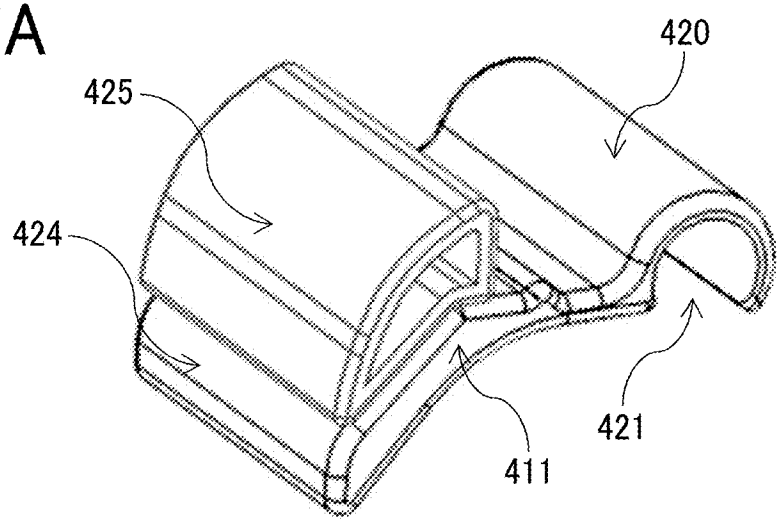
FIGS. 17A, 17B, and 17C are diagrams each illustrating a pressing member according to Modification 4 of the present disclosure.
Figure 17B:
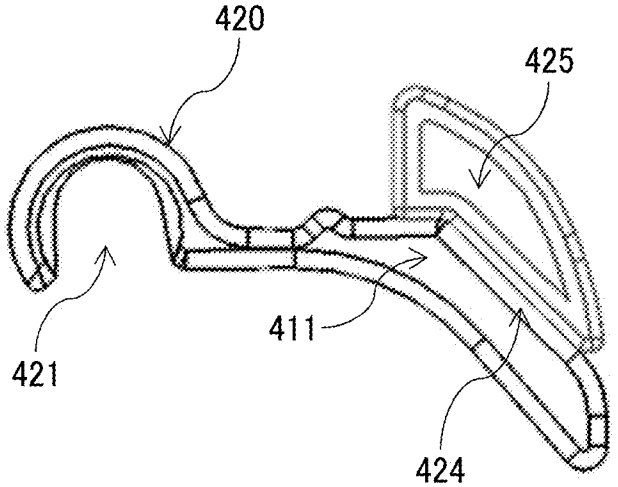
Figure 17C:
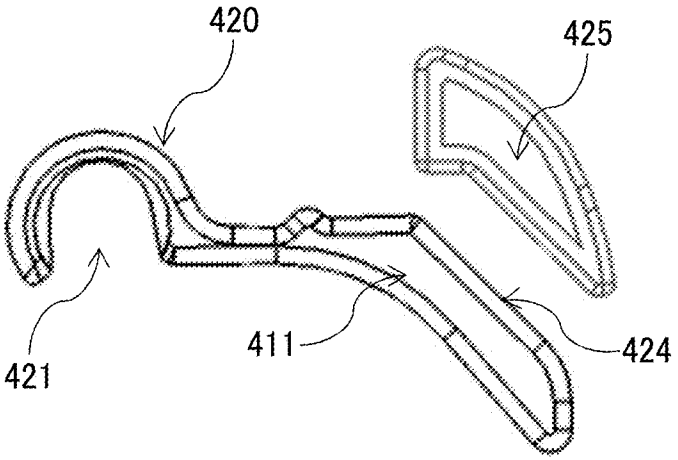

A pressing member according to yet another modification of the present embodiment can be formed based on the pressing member 411 according to the comparative example. For example, the separate member 425 having a curved portion is detachably attached to the stacked sheet contact portion 424 of the pressing member 411 according to the comparative example. In other words, the pressing member according to the present modification may include two members in combination as illustrated in FIGS. 17A to 17C. For example, a double-sided adhesive tape is used for attachment of the separate member 425. In Modification 4, a contact portion formed on the separate member 425 and the pressing portion of the pressing member 411 are connected in a curved shape convex in the sheet ejection direction.

In this case, for example, without any dramatic change in the shape of the already used component, an effect of preventing a sheet from being pushed out can be obtained with the component. A combination of two members has been exemplified, but three or more members may be combined. For attachment, a member other than a two-sided adhesive tape may be used.

Then, the support 420 has the cutaway portion 421 facing downward (to the side of location of the sheet ejection tray 303). Preferably, the support 420 has the cutaway portion 421 facing upward (to the side of location of the sheet reverse driven roller 306).

Image Forming Apparatus according to Another Embodiment

Figure 18:
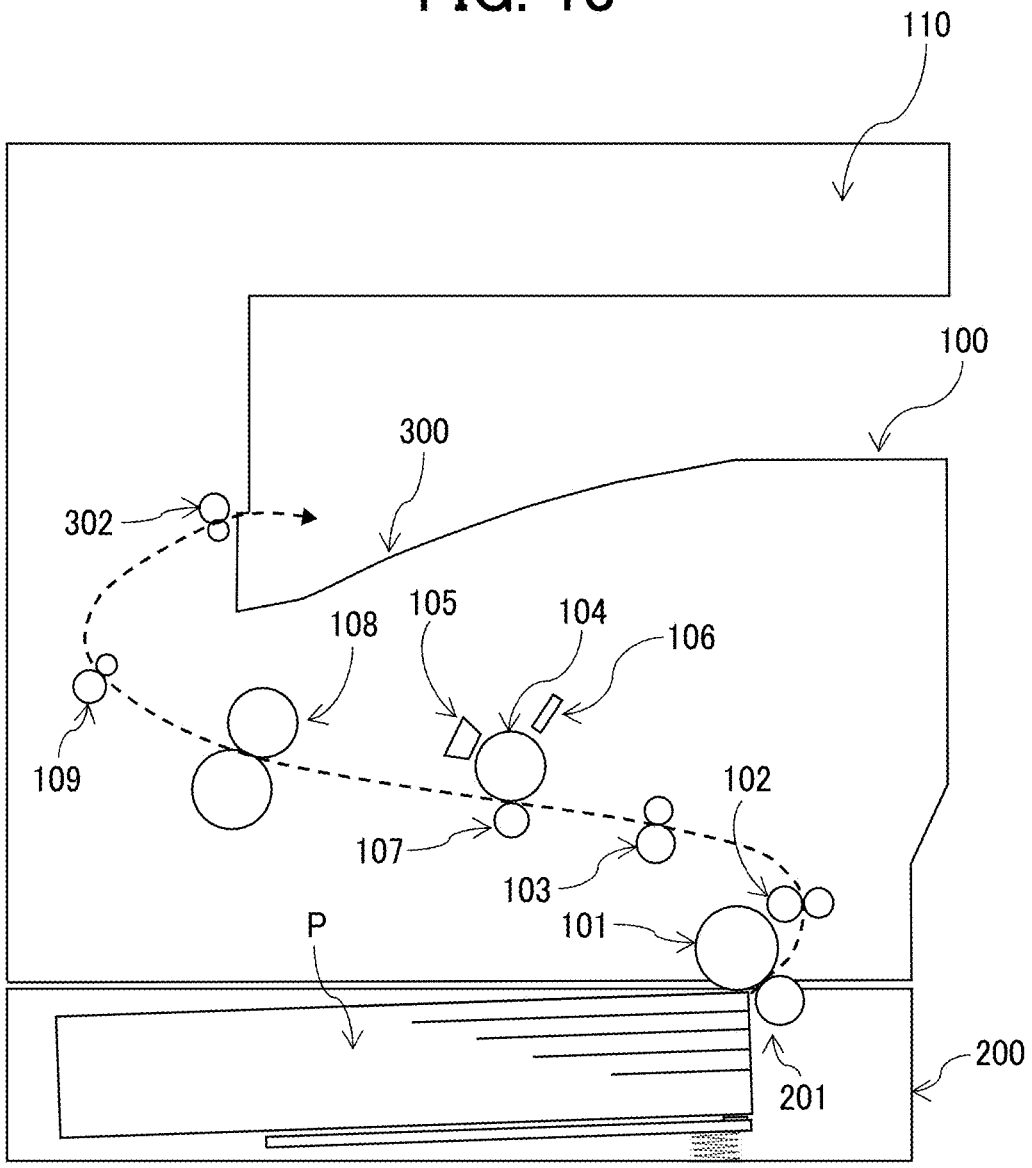
FIG. 18 is a diagram illustrating another configuration of an image forming apparatus according to another embodiment of the present disclosure.

FIG. 18 is a diagram illustrating another configuration of an image forming apparatus according to another embodiment of the present disclosure.

Typically, a multifunction peripheral (MIT) includes a printer on which an electrical-component unit or a scanner that reads a document is mounted. Then, the image forming apparatus illustrated in FIG. 18 serves as an MFP including a printer 100 on which a scanner 110 is mounted as a reading device. In this case, the scanner 110 is provided above the sheet ejection tray 303. An arrangement space in which a toner bottle for supplying toner is disposed below the sheet ejection tray 303. Currently, the size of the overall image forming apparatus is reduced for effective use of a little installation space. For such a configuration, since a space for ejecting a sheet is limited, the sheet ejection tray 303 is desired to have a small angle of inclination (in other words, a gentle angle of inclination). Thus, in the present embodiment, the image forming apparatus has an angle of inclination of 12 degrees smaller than the angle of inclination of the sheet ejection tray 303 of the image forming apparatus illustrated in FIG. 1.

The pressing member 311 according to the present disclosure enables, in a configuration in which the sheet ejection tray 303 has a small angle of inclination, sufficient prevention of a sheet from being pushed out, leading to an enhancement of the sheet stackability. An example of a case where the scanner 110 is mounted on the printer 100 has been given. For example, even in a case where an electrical-component unit or an automatic document feeder (ADF) that conveys a document is mounted, a similar effect can be obtained.

In the present disclosure, the pressing member for sheets has been described as a contact member, but this is not limiting. Thus, the present disclosure can be applied to any other contact member. For example, the present embodiment may be applied to the configuration of the full detection feeler.

The above description is exemplary, and the following aspects of the present embodiment have respective particular effects.

First Aspect

According to a first aspect, a sheet ejection device (e.g., a sheet ejection device 300) to eject a sheet (e.g., a sheet P) to a stacker (e.g., a sheet ejection tray 303) includes the stacker, and a contact member (e.g., a pressing member 311 or a full detection feeler 314) to pivot in response to contact with an ejection sheet to the stacker. The contact member includes an ejection sheet contact portion (e.g., an ejection sheet contact member 322) in contact with the ejection sheet, a stacked sheet contact portion (e.g., a stacked sheet contact portion 324) located opposite the ejection sheet contact portion, the stacked sheet contact portion including a contact portion (e.g., a contact portion 325) in contact with a stacked sheet stacked on the stacker, and a pressing portion (e.g., a pressing portion 323) to press the stacked sheet. The contact portion and the pressing portion are connected in a curved shape convex in a sheet ejection direction.

Second Aspect

According to a second aspect, in the sheet ejection device of the first aspect, the contact member includes a top portion (e.g., a top portion 329) as an end portion located opposite the pressing portion of the stacked sheet contact portion, and a distance (e.g., a distance G2) from a center of pivoting of the contact member to the top portion is longer than a distance (e.g., a distance G1) from the center of pivoting of the contact member to the pressing portion.

Third Aspect

According to a third aspect, in the sheet ejection device of the first or second aspect, the curved shape is expanded in the sheet ejection direction such that a reduction is made in an angle between the stacked sheet contact portion and the stacked sheet.

Fourth Aspect

According to a fourth aspect, the sheet ejection device of any of the first to third aspects further includes a contact-member support (e.g., a rotary shaft 301) that supports the contact member, in which the contact member includes a support (e.g., a support 320) through which the contact member is supported to the sheet ejection device, and the support includes an insertion opening (e.g., a cutaway portion 321) through which the contact-member support is inserted, Fifth Aspect According to a fifth aspect, in the sheet ejection device of the fourth aspect, the insertion opening has a shape due to cutting-away of part of a circle in side view, and the contact member is supported, based on insertion of the contact-member support through the insertion opening, such that the insertion opening is located on a side opposite to a side of location of the stacker.

Sixth Aspect

According to a sixth aspect, the sheet ejection device of any of the first to fifth aspects further includes a stopper (e.g., a stopper 304) to contact the contact member to stop pivoting of the contact member.

Seventh Aspect

According to a seventh aspect, in the sheet ejection device of any of the first to sixth aspects, the contact member is provided corresponding to an end portion in a width direction of the ejection sheet having a predetermined size.

Eighth Aspect

According to an eighth aspect, the sheet ejection device of any of the first to seventh aspects further includes a stopper to stop pivoting of the contact member, in which the contact member includes a stopper contact portion (e.g., a recessed contact portion 327 or a stopper contact portion 627) to contact the stopper, and the stopper contact portion expends straight from a center of pivoting of the contact member to the stacked-sheet contact portion.

Ninth Aspect

According to a ninth aspect, in the sheet ejection device of any of the first to eighth aspects, the stacked sheet contact portion is formed at part in a sheet-width direction of the contact member (e.g., a rib 330).

Tenth Aspect

According to a tenth aspect, the sheet ejection device of any of the first to ninth aspects further includes a stopper to stop pivoting of the contact member, in which the contact member includes: a top portion as an end portion located opposite the pressing portion of the stacked sheet contact portion; a stopper contact portion to contact on the stopper; and another stacked sheet contact portion (e.g., a second stacked sheet contact portion 331) connecting, in a curved shape, the top portion and the stopper contact portion.

Eleventh Aspect

According to an eleventh aspect, in the sheet ejection device of any of the first to tenth aspects, the stacked sheet contact portion includes multiple members (e.g., a separate member 425) in combination.

Twelfth Aspect

According to a twelfth aspect, an image forming apparatus (e.g., a printer 100) includes the sheet ejection device of any of the first to eleventh aspects.

Thirteenth Aspect

According to a thirteenth aspect, the image forming apparatus of the twelfth aspect further includes a reading device (e.g., a scanner 110) provided above the stacker. The reading device reads a document, Fourteenth Aspect According to a fourteenth aspect, a sheet ejection device (e.g., the sheet ejection device 300) includes a stacker (e.g., the sheet ejection tray 303) to stack a sheet (e.g., the sheet P) ejected to the stacker in a sheet ejection direction, and a contact member (e.g., the pressing member 311 or the full detection feeler 314) to pivot when the contact member is in contact with an ejection sheet moving to the stacker. The contact member includes an ejection sheet contact portion (e.g., the ejection sheet contact member 322) to contact the ejection sheet, a stacked sheet contact portion (e.g., the stacked sheet contact portion 324) disposed opposite the ejection sheet contact portion, the stacked sheet contact portion including a contact portion (e.g., the contact portion 325) to contact a stacked sheet stacked on the stacker, and a pressing portion (e.g., the pressing portion 323) to press the stacked sheet, the pressing portion disposed at an intersection between the ejection sheet contact portion and the stacked sheet contact portion. The contact portion has a curved shape (e.g., the curved portion 525 or the curved portion 526) convex in the sheet ejection direction.

Fifteenth Aspect

According to a fifteenth aspect, in the sheet ejection device of the fourteenth aspect, the contact member (e.g., the pressing member 311 or the full detection feeler 314) includes a top portion (e.g., the top portion 329) as an end portion of the stacked sheet contact portion (e.g., the stacked sheet contact portion 324). The top portion is disposed opposite the pressing portion as another end portion of the stacked sheet contact portion. A first distance (e.g., the distance G2) from a pivot of the contact member to the top portion is longer than a second distance from the center of the pivot of the contact member to the pressing portion.

Sixteenth Aspect

According to a sixteenth aspect, in the sheet ejection device of the fourteenth aspect or the fifteenth aspect, the curved shape is expanded in the sheet ejection direction to form a first angle between the stacked sheet contact portion (e.g., the stacked sheet contact portion 324) and the stacked sheet to be smaller than a second angle between a straight contact portion and the stacked sheet.

Seventeenth Aspect

According to a seventeenth aspect, in the sheet ejection device of any one of the fourteenth to sixteenth aspects further includes a contact member support (e.g., a rotary shaft 301) to support the contact member (e.g., the pressing member 311). The contact member includes a support (e.g., the support 320) detachably attached to the contact member support. The support includes an insertion portion (e.g., the cutaway portion 321) to which the contact member support is inserted.

Eighteenth Aspect

According to an eighteenth aspect, in the sheet ejection device of the seventeenth aspect, the insertion portion (e.g., the cutaway portion 321) includes a cutaway portion (e.g., the cutaway portion 321) that is disposed opposite to the stacker (e.g., the sheet ejection tray 303) in a state in which the insertion portion is inserted to the contact member support (e.g., the rotary shaft 301).

Nineteenth Aspect

According to a nineteenth aspect, the sheet ejection device of any one of the fourteenth to seventeenth aspects further includes a stopper (e.g., the stopper 304) to contact the contact member (e.g., the pressing member 311) at a stop position to stop pivoting of the contact member.

Twentieth Aspect

According to a twentieth aspect, in the sheet ejection device of any one of the fourteenth to nineteenth aspects, the contact member (e.g., the pressing member 311) has the contact portion (e.g., the contact portion 325) at an end portion of the contact member in a width direction of the ejection sheet having a predetermined size.

Twenty-First Aspect

According to a twenty-first aspect, the sheet ejection device of any one of the fourteenth to twentieth aspects further includes a stopper (e.g., the stopper 304) to stop pivoting of the contact member (e.g., the pressing member 311) at a stop position. The contact member includes a stopper contact portion (e.g., a recessed contact portion 327 or a stopper contact portion 627) to contact the stopper at the stop position. The stopper contact portion extends straight from a pivot of the contact member to portion.

Twenty-Second Aspect

According to a twenty-second aspect, in the sheet ejection device of any one of the fourteenth to twenty-first aspects, the stacked sheet contact portion (e.g., the stacked sheet contact portion 324) includes a protruding portion (e.g., a rib 330) formed at a part of the contact member (e.g., the pressing member 311) in a sheet width direction orthogonal to the sheet ejection direction.

Twenty-Third Aspect

According to a twenty-third aspect, the sheet ejection device of any one of the fourteenth to twenty-second aspects further includes a stopper (e.g., the stopper 304) to stop pivoting of the contact member (e.g., the pressing member 311) at a stop position. The contact member includes a top portion (e.g., the top portion 329) as an end portion disposed opposite the pressing portion of the stacked sheet contact portion, a stopper contact portion (e.g., a recessed contact portion 327 or a stopper contact portion 627) to contact the stopper at the stop position, and another stacked sheet contact portion (e.g., the second stacked sheet contact portion 331) connecting the top portion and the stopper contact portion and having another curved shape (e.g., the curved portion 525 or the curved portion 526) convex in a direction opposite to the sheet ejection direction.

Twenty-Fourth Aspect

According to a twenty-fourth aspect, in the sheet ejection device of any one of the fourteenth to twenty-third aspects, the stacked sheet contact portion (e.g., the second stacked sheet contact portion 331) includes combined multiple members (e.g., the stacked sheet contact portion 424 or the separate member 425), Twenty-Fifth Aspect According to a twenty-fifth aspect, in the sheet ejection device of the twenty-second aspect, the protruding portion (e.g., the rib 330) having the curved shape (e.g., the curved portion 525 or the curved portion 526) convex in the sheet ejection direction is detachably attachable to the stacked sheet contact portion (e.g., the stacked sheet contact portion 424).

Twenty-Sixth Aspect

According to a twenty-sixth aspect, an image forming apparatus (e.g., the printer 100) includes the sheet ejection device (e.g., the sheet ejection device 300) of any one of the fourteenth to twenty-fifth aspects, and an image forming device (e.g., the image forming device 150) to form an image on the sheet.

Twenty-Seventh Aspect

According to a twenty-seventh aspect, in the image forming apparatus of the twenty-sixth aspect further includes a document reader (e.g., the scanner 110) over the stacker (e.g., the sheet ejection tray 303) to read a document stacked on the stacker.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet ejection device comprising:

a stacker to stack a sheet ejected to the stacker in a sheet ejection direction; and a contact member to pivot when the contact member is in contact with an ejection sheet moving to the stacker, the contact member including:

an ejection sheet contact portion to contact the ejection sheet, the ejection sheet contact portion having a first upwardly curved face that is disposed to face the ejection sheet at a posture of the contact member lifted by the ejected sheet;

a stacked sheet contact portion disposed opposite the ejection sheet contact portion, the stacked sheet contact portion including a contact portion to contact a stacked sheet stacked on the stacker; and a pressing portion to press the stacked sheet, the pressing portion disposed at an intersection between the ejection sheet contact portion and the stacked sheet contact portion, wherein the contact member includes a top portion as one end portion of the stacked sheet contact portion, the contact portion has a second upwardly curved face in the sheet ejection direction, and the top portion is protruded above a rotary shaft at a position where the contact member is lifted by the ejected sheet.

2. The sheet ejection device according to claim 1, wherein the curved shape is expanded in the sheet ejection direction to form a first angle between the stacked sheet contact portion and the stacked sheet to be smaller than a second angle between a straight contact portion and the stacked sheet.

3. The sheet ejection device according to claim 1, further comprising a contact member support to support the contact member, wherein the contact member includes a support detachably attached to the contact member support, and the support includes an insertion portion to which the contact member support is inserted.

4. The sheet ejection device according to claim 3, wherein the insertion portion includes a cutaway portion disposed opposite to the stacker in a state in which the insertion portion is inserted to the contact member support.

5. The sheet ejection device according to claim 1, further comprising a stopper to contact the contact member at a stop position to stop pivoting of the contact member.

6. The sheet ejection device according to claim 1, wherein the contact member has the contact portion at an end portion of the contact member in a width direction of the ejection sheet having a predetermined size.

7. The sheet ejection device according to claim 1, wherein the contact portion is extended upstream in the sheet ejection direction from the pressing portion, at the posture of the contact member lifted by the ejected sheet.

8. The sheet ejection device according to claim 7, wherein the first upwardly curved face of the ejection sheet contact portion is extended upstream in the sheet ejection direction from the pressing portion, at the posture of the contact member lifted by the ejected sheet.

9. An image forming apparatus comprising:

the sheet ejection device according to claim 1; and an image forming device to form an image on the sheet.

10. The image forming apparatus according to claim 9, further comprising a document reader over the stacker to read a document stacked on the stacker.

* * * * *